US009436140B2

(12) United States Patent
Yonekubo et al.

(10) Patent No.: US 9,436,140 B2
(45) Date of Patent: Sep. 6, 2016

(54) FIXING DEVICE CONTROLLING FREQUENCY OF AC CURRENT CAUSED TO FLOW THROUGH HELICAL COIL CAUSING ELECTROCONDUCTIVE LAYER OF ROTATABLE MEMBER TO GENERATE HEAT THROUGH ELECTROMAGNETIC INDUCTION

(71) Applicant: CANON KABUSHIKI KAISHA, Tokyo (JP)

(72) Inventors: Hideaki Yonekubo, Suntou-gun (JP); Hisashi Nakahara, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/837,555

(22) Filed: Aug. 27, 2015

(65) Prior Publication Data

US 2016/0062285 A1 Mar. 3, 2016

(30) Foreign Application Priority Data

Aug. 28, 2014 (JP) ..... 2014-173914

(51) Int. Cl.
*G03G 15/20* (2006.01)

(52) U.S. Cl.
CPC ..... *G03G 15/2039* (2013.01); *G03G 15/205* (2013.01); *G03G 15/2078* (2013.01)

(58) Field of Classification Search
CPC ..... G03G 15/2039; G03G 15/2042; G03G 15/205; G03G 15/2078; G03G 15/2082; G03G 15/2053
USPC ..... 399/69, 70, 334; 219/216, 619, 660
See application file for complete search history.

(56) References Cited

U.S. PATENT DOCUMENTS

| | | | | |
|---|---|---|---|---|
| 7,203,438 | B2 | 4/2007 | Omata et al. | |
| 8,532,554 | B2 | 9/2013 | Uchiyama et al. | |
| 8,755,705 | B2 | 6/2014 | Nakahara et al. | |
| 9,110,416 | B2 | 8/2015 | Uchiyama et al. | |
| 2002/0006296 | A1* | 1/2002 | Omoto | G03G 15/2053 399/330 |
| 2003/0077092 | A1 | 4/2003 | Ogawa et al. | |
| 2009/0238593 | A1* | 9/2009 | Kinouchi | G03G 15/2042 399/67 |
| 2011/0222889 | A1* | 9/2011 | Tabuchi | G03G 15/2039 399/69 |
| 2015/0139706 | A1 | 5/2015 | Fujiwara et al. | |
| 2015/0139708 | A1 | 5/2015 | Shimura et al. | |
| 2015/0168896 | A1* | 6/2015 | Yonekubo | G03G 15/2053 399/329 |

FOREIGN PATENT DOCUMENTS

| | | | |
|---|---|---|---|
| JP | 2002323829 | A * | 11/2002 |
| JP | 2003-317923 | A | 11/2003 |
| JP | 2003-347030 | A | 12/2003 |
| JP | 2004061650 | A * | 2/2004 |

(Continued)

*Primary Examiner* — Robert Beatty
(74) *Attorney, Agent, or Firm* — Fitzpatrick, Cella, Harper & Scinto

(57) ABSTRACT

A fixing device includes: a rotatable member; a helical coil; a magnetic core; and a controller for controlling the frequency of an AC current caused to flow through the coil. The AC current is caused to flow through the coil to cause an electroconductive layer of the rotatable member to generate heat through electromagnetic induction heating, thereby heating and fixing the toner image on the recording material by heat of the rotatable member. The controller controls the frequency in a period so that when the frequency is f and a resistance of the electroconductive layer with respect to a circumferential direction is R, f/R is substantially constant.

16 Claims, 22 Drawing Sheets

(56) References Cited

FOREIGN PATENT DOCUMENTS

| | | | | |
|---|---|---|---|---|
| JP | 2005050624 | A | * | 2/2005 |
| JP | 2008-191258 | A | | 8/2008 |
| JP | 4218478 | B2 | | 2/2009 |
| JP | 2009069280 | A | * | 4/2009 |
| JP | 4423986 | B2 | | 3/2010 |

* cited by examiner (a)

(b)

(a)

(b)

(a)

(b)

$$|X| = \frac{1}{\sqrt{\left(\frac{1}{R'}\right)^2 + \left(\frac{1}{\omega M}\right)^2}}$$

(a)

(b)

(a)

(b)

(c)

$$|X_e| = \frac{1}{\sqrt{\left(\frac{1}{6^2R}\right)^2+\left(\frac{1}{\omega M_e}\right)^2}} \qquad |X_c| = \frac{1}{\sqrt{\left(\frac{1}{6^2R}\right)^2+\left(\frac{1}{\omega M_c}\right)^2}}$$

FIXING DEVICE CONTROLLING FREQUENCY OF AC CURRENT CAUSED TO FLOW THROUGH HELICAL COIL CAUSING ELECTROCONDUCTIVE LAYER OF ROTATABLE MEMBER TO GENERATE HEAT THROUGH ELECTROMAGNETIC INDUCTION

FIELD OF THE INVENTION AND RELATED ART

The present invention relates to a fixing device (image heating apparatus) mounted in an image forming apparatus.

An image heating apparatus (fixing device) mounted in an image forming apparatus, such as a copying machine or a printer, of an electrophotographic type includes a rotatable heating member and a pressing roller for forming a nip in contact with the rotatable heating member in general. This fixing device heats and fixes at the nip a toner image on a recording material while feeding the recording material on which the toner image is carried.

In recent years, an image heating apparatus for causing an electroconductive layer of a rotatable heating member to generate heat through electromagnetic induction heating has been proposed, and this image heating apparatus has advantages that a warm-up time is short and that electric power consumption is low.

Japanese Laid-Open Patent Application (JP-A) 2008-191258 and JP-A 2003-347030 disclose an image heating apparatus of a type in which an AC magnetic field is generated in an axial direction of a rotatable heating member and heat is generated by Joule heat resulting from eddy current generated in a circumferential direction of the rotatable heating member.

In the image heating apparatus as described above, in order to prevent fixing non-uniformity of an image, it is desired that a distribution of heat generation with respect to a longitudinal direction of a fixing sleeve is made uniform. In JP-A 2003-347030, the distribution of heat generation is uniformized by a method in which resistivity of a heat generating layer of the fixing sleeve is changed with respect to the longitudinal direction or by the like method.

However, in the method, in the case where a TCR (temperature coefficient of resistance) of the fixing sleeve is not zero, there is a problem that it is difficult to uniformize the distribution of heat generation with respect to the longitudinal direction of the fixing sleeve particularly during rising (warm-up).

The reason therefor will be described. A heat generation amount Pe generated eddy current in the heat generating layer of the fixing sleeve is represented by the following formula (A).

$$Pe=Ke(tfBm)^2/\rho \quad (A)$$

Pe: Heat generation amount generated by eddy current loss t: Thickness of fixing sleeve (heat generating layer)

f: Frequency

Bm: Maximum magnetic flux density

ρ: Resistivity ke: Constant of proportionality

As shown in the formula (A), the heat generation amount Pe of the heat generating layer of the fixing sleeve depends on the resistivity ρ. In the case where the TCR of the heat generating layer is not zero, the resistivity ρ is liable to change particularly during rising in which a temperature change is large, so that also the heat generation amount Pe of the heat generating layer of the fixing sleeve changes.

In JP-A 2003-347030, the resistivity of the heat generating layer is changed with respect to the longitudinal direction, and therefore the heat generation distribution with respect to the longitudinal direction changes during a rising period. For that reason, the influence of the heat generation distribution remains as a fixing sleeve temperature immediately after the rising. In such a state, when printing is made, an image defect such as fixing non-uniformity or hot-offset of the image generates in some cases.

SUMMARY OF THE INVENTION

According to an aspect of the present invention, there is provided a fixing device for fixing a toner image on a recording material, comprising: a rotatable member including an electroconductive layer; a helical coil provided at a hollow portion of the rotatable member, the helical coil having a helical axis direction along a generatrix direction of the rotatable member; a magnetic core provided inside a helically shaped portion formed by the coil; and a controller for controlling a frequency of an AC current caused to flow through the coil, wherein the AC current is caused to flow through the coil to cause the electroconductive layer to generate heat through electromagnetic induction heating thereby to heat and fix the toner image on the recording material by heat of the rotatable member, and wherein the controller controls the frequency in a period so that when the frequency is f and a resistance of the electroconductive layer with respect to a circumferential direction is R, f/R is substantially constant.

According to another aspect of the present invention, there is provided a fixing device for fixing a toner image on a recording material, comprising: a rotatable member including an electroconductive layer; a helical coil provided at a hollow portion of the rotatable member, the helical coil having a helical axis direction along a generatrix direction of the rotatable member; a magnetic core provided inside a helically shaped portion formed by the coil; and a controller for controlling a frequency of an AC current caused to flow through the coil, wherein the AC current is caused to flow through the coil to cause the electroconductive layer to generate heat through electromagnetic induction heating thereby to heat and fix the toner image on the recording material by heat of the rotatable member, and wherein the controller controls the frequency in a period for effecting warm-up of the fixing device so that when the frequency is f and a resistance of the electroconductive layer with respect to a circumferential direction is R, f/R starting from a value larger than an predetermined value gradually converges to the predetermined value.

According to a further aspect of the present invention, there is provided a fixing device for fixing a toner image on a recording material, comprising: a rotatable member including an electroconductive layer; a helical coil provided at a hollow portion of the rotatable member, the helical coil having a helical axis direction along a generatrix direction of the rotatable member; a magnetic core provided inside a helically shaped portion formed by the coil; and a controller for controlling a frequency of an AC current caused to flow through the coil, wherein the AC current is caused to flow through the coil to cause the electroconductive layer to generate heat through electromagnetic induction heating thereby to heat and fix the toner image on the recording material by heat of the rotatable member, and wherein the controller controls the frequency in a period for effecting warm-up of the fixing device so that a heat generation amount of the electroconductive layer with respect to the generatrix direction of the electroconductive layer is substantially uniform.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

<General structure of image forming apparatus>

Figure 1:
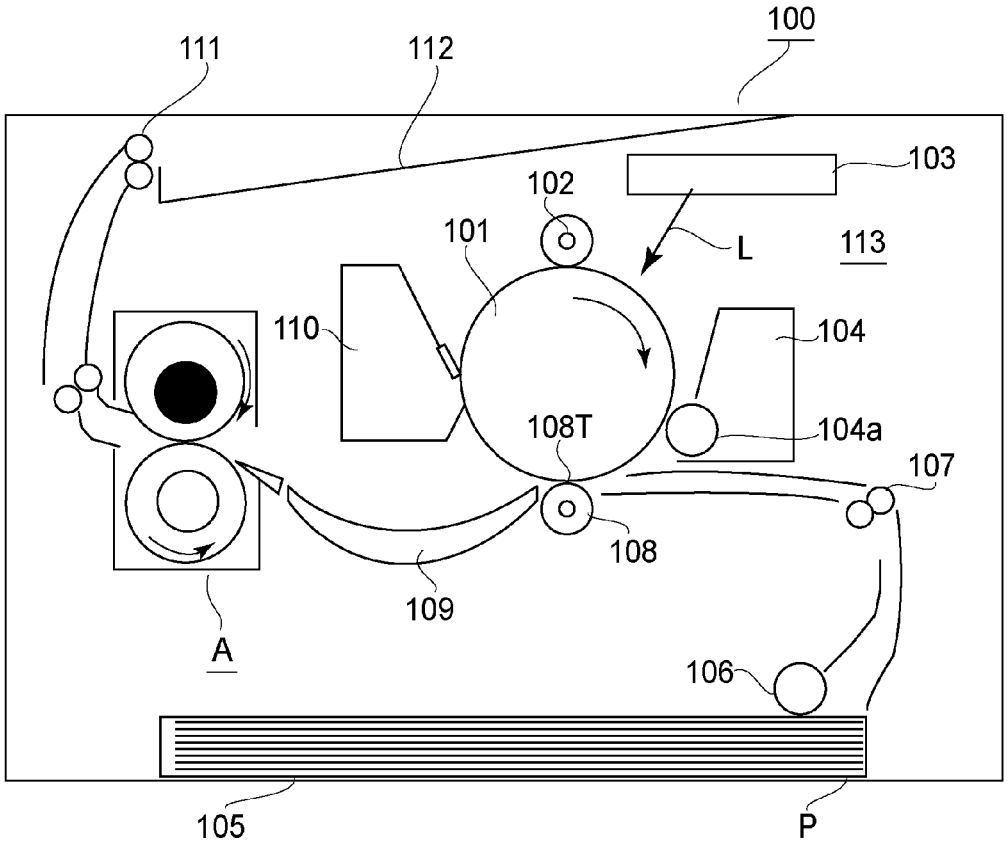
FIG. 1 is a schematic view of an example of an image forming apparatus in which an image heating apparatus in Embodiment 1 is used as a fixing device.

FIG. 1 is a schematic structural view of an example of an image forming apparatus 100 using an image heating apparatus in this embodiment as a fixing device. The image forming apparatus 100 is a laser beam printer of an electrophotographic type. A photosensitive drum 101 as an image bearing member is rotationally driven in the clockwise direction indicated by an arrow at a predetermined process speed (peripheral speed). In a rotation process of the photosensitive drum 101, the drum 101 is electrically charged uniformly to a predetermined polarity and a predetermined potential by a charging roller 102.

A laser beam scanner 103 as an image exposure means outputs laser light L which is ON/OFF-modulated correspondingly to a digital image (pixel) signal inputted from an external device 42 (FIG. 3) such as a host computer and generated by an image processing portion 41 (printer controller). Then, a charged surface of the drum 101 is subjected to scanning exposure. The digital image signal is an image signal for image formation generated from image data received from the external device 42. By this scanning exposure, an electric charge at an exposed light portion of the drum 101 surface is removed, so that an electrostatic latent image corresponding to the image signal is formed on the drum 101 surface. A developing device 104 includes a developing roller 104*a* from which a developer (toner) is supplied to the surface of the drum 101, so that the electrostatic latent image on the surface of the drum 101 surface is successively developed into a toner image which is a visible image.

In the following description, with respect to a sheet-shaped recording material as a recording medium, terms relating to paper (sheet) such as paper (sheet) feeding, paper passing, paper passing portion, non-paper-passing portion, non-paper-passing region, paper powder, paper discharge, paper interval, paper passing width, large-sized paper, small-sized paper, and paper are used. However, the recording material is not limited to the paper, but may also be a resin sheet, coated paper or the like.

A width or a width size of the recording material is a dimension of the recording material with respect to a direction perpendicular to a recording material feeding direction on a recording material surface. A recording material having a maximum size usable in (feedable into) the image forming apparatus or the fixing device is referred to as a large-sized recording material, and a recording material having a width narrower than the width of the large-sized recording material is referred to as a small-sized recording material.

In a paper feeding cassette 105, sheets of a recording material P are stacked and accommodated. A paper feeding roller 106 is driven on the basis of a paper feeding start signal, so that the recording material P in the paper feeding cassette 105 is separated and fed one by one. Then, the recording material P is introduced at predetermined timing into a transfer portion 108T, which is a contact nip portion between the photosensitive drum 101 and a transfer roller 108 rotated by the drum 1 in contact with the drum 1, via registration roller pair 107. That is, the feeding of the recording material P is controlled by the registration roller pair 107 so that a leading end portion of the toner image on the drum 101 and a leading end portion of the recording material P reach the toner portion 108T at the same time.

Thereafter, the recording material P is nipped and fed through the transfer portion 108T, and during the feeding, to the transfer roller 108, a transfer voltage (transfer bias) controlled in a predetermined manner is applied from an unshown transfer bias applying power source. Specifically, to the transfer roller 108, the transfer bias of an opposite polarity to the charge polarity of the toner is applied, so that the toner image is electrostatically transferred from the surface of the drum 101 onto the surface of the recording material P at the transfer portion 108T. The recording material P after the transfer is separated from the surface of the drum 101 and passes through a feeding guide 109, and then is introduced into a fixing device (fixing portion) A.

In the fixing device A, the toner image on the recording material P is heat-fixed. On the other hand, the surface of the drum 101 after the transfer of the toner image onto the recording material P is subjected to removal of a transfer residual toner, paper powder or the like by a cleaning device 110 to be cleaned, so that the photosensitive drum surface is repetitively subjected to image formation. The recording material P passed through the fixing device A is discharged onto a paper discharge tray 112 through a paper discharge opening 111.

Figure 2:
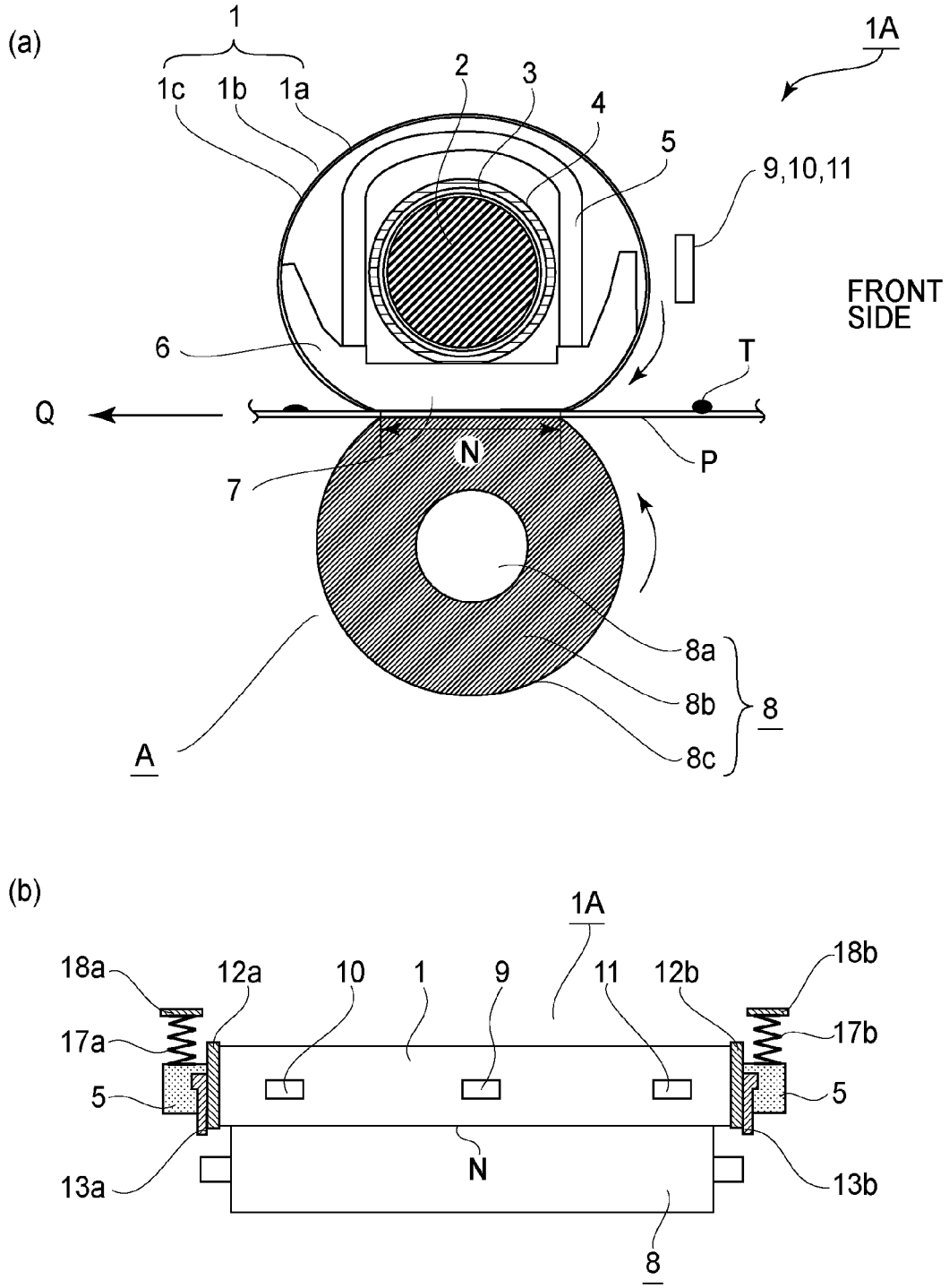
In FIG. 2, (a) is a cross-sectional view of a principal part of the fixing device, and (b) is a front view of the principal part of the fixing device.

In the image forming apparatus 100, an apparatus mechanism portion including from the charging roller 102 to the fixing device A is an image forming portion 113 for forming the toner image T ((a) of FIG. 2) on the recording material P.

2. Fixing Device

Figure 3:
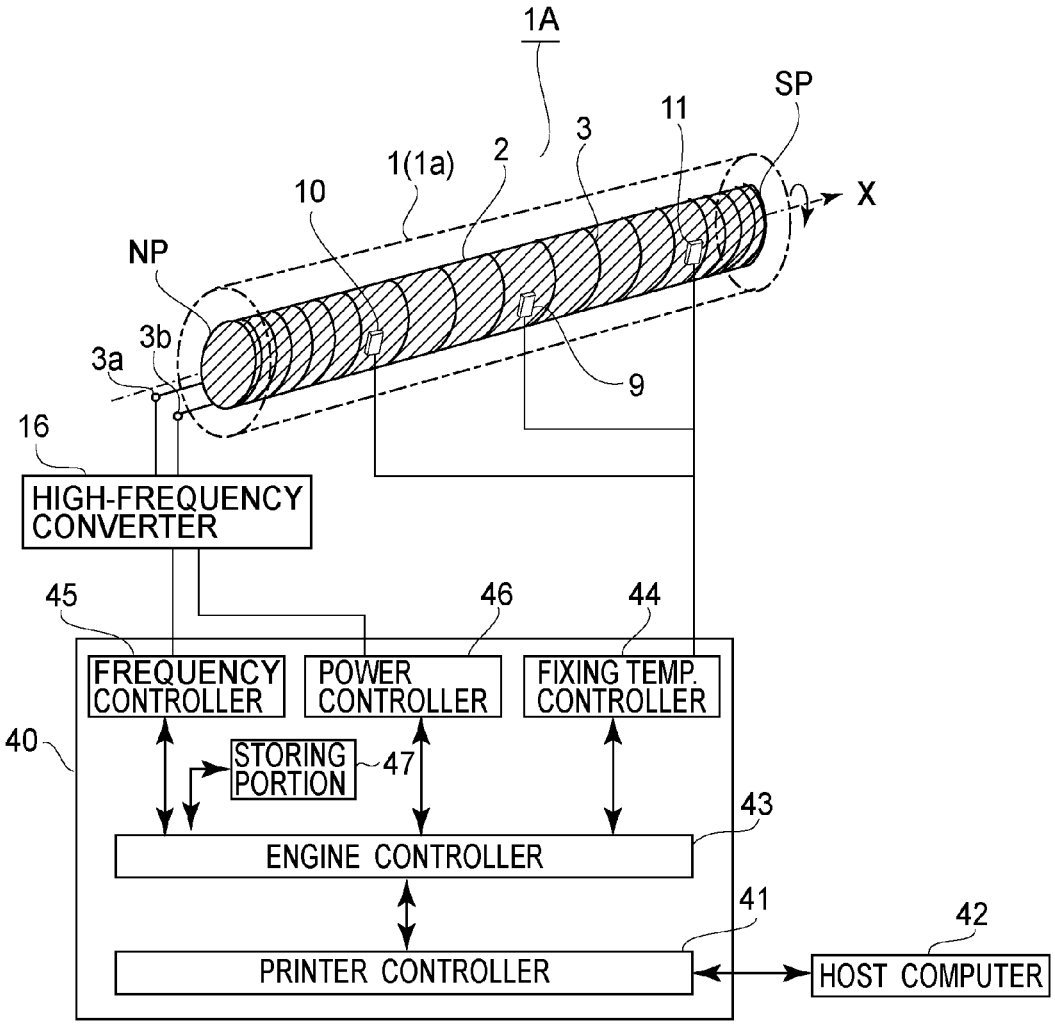
FIG. 3 is a schematic view showing a heating unit for the fixing device and a block circuit diagram of a control system.

In this embodiment, the fixing device A is an image heating apparatus of an electromagnetic induction heating type. In FIG. 2, (a) is a cross-sectional view of a principal part of the fixing device A in this embodiment, and (b) is a front view of the principal part of the fixing device A. FIG. 3 is a schematic view showing a heating unit for the fixing device A and a block circuit diagram of a control system. Here, with respect to the fixing device A, a front side is a side where the recording material P is introduced. Left and right are those of the fixing device A as seen from the front side.

The fixing device A roughly includes a heating unit 1A and a pressing roller 8 as a nip forming member (pressing member). The heating unit 1A and the pressing roller 8 from a fixing nip N where the toner image T is fixed under application of heat and pressure while feeding the recording material P in contact with each other.

The heating unit 1A includes a fixing sleeve 1 which is a cylindrical rotatable member (rotatable heating member) having an electroconductive layer. At an inner hollow portion, a magnetic core 2 as a magnetic member, an exciting coil 3 wound around the magnetic core 2, a pressing stay 5, a sleeve guide member 6, and the like which will be described hereinafter are provided.

A pressing roller 8 is constituted by a core metal 8*a* and a heat-resistant elastic material layer 8*b* which is coated and molded concentratedly integral with the core metal 8*a* in a roller shape, and a parting layer 8*c* is provided as a surface layer. As a material for the elastic layer 8*b*, a heat-resistant material such as a silicone rubber, a fluorine-containing rubber or a fluoro-silicone rubber is preferred. The core metal 8*a* is rotatably held at end portions thereof between unshown chassis side plates of the fixing device via electroconductive bearings.

The heating unit 1A is arranged in parallel with and on the pressing roller 8.

Further, between end portions of a pressing stay 5 and spring-receiving members 18*a*, 18*b* in a device chassis side, pressing springs 17*a*, 17*b* are compressedly provided, respectively, so that a pressing-down force is caused to act on the pressing stay 5. In the fixing device A in this embodiment, a pressing force of about 100 N-250 N (about 10 kgf-25 kgf) as a total pressure is applied.

As a result, a lower surface of a sleeve guide member 6 formed of heat-resistant PPS or the like and an upper surface of the pressing roller 8 nip and press-contact the fixing sleeve 1 from the inside and the outside of the fixing sleeve 1, so that a fixing nip N having a predetermined width is formed with respect to a recording material feeding direction Q.

The sleeve guide member 6 is a back-up member (nip forming member) which contacts the inner surface of the fixing sleeve 1 and which opposes the pressing roller 8, and performs the functions of not only holding the fixing sleeve 1 but also guiding the rotation of the fixing sleeve 1.

The pressing roller 8 is rotationally driven in the counterclockwise direction of an arrow in (a) of FIG. 2 by an unshown driving means, so that a rotational force acts on the fixing sleeve 1 by a frictional force with an outer surface of the fixing sleeve 1 in the fixing nip N. As a result, the fixing sleeve 1 is rotated in the clockwise direction of an arrow by the pressing roller 8 while hermetically contacting the surface of the sleeve guide member 6 at the inner surface thereof in the fixing nip N. The recording material P is introduced into the fixing nip N and is nipped and fed.

Flange members 12*a*, 12*b* are fitted around left and right end portions (one end portion and the other end portion) of the sleeve guide member 6 in the heating unit 1A, so that left and right positions thereof are rotatably mounted while being fixed by regulating (limiting) members 13*a*, 13*b*. During the rotation of the fixing sleeve 1, the flange 12*a*, 12*b* receive the end portions of the fixing sleeve 1 and have the function of limiting movement of the fixing sleeve 1 along a longitudinal direction. As a material for the flanges 12*a*, 12*b*, a high heat-resistant material such as LCP (liquid crystal polymer) resin or the like is preferred.

The fixing sleeve 1 is a cylindrical rotatable member which is 10-50 mm in diameter and which has flexibility and a composite structure including a heat generating layer (electroconductive layer) 1*a* as a base layer formed with an electroconductive member, an elastic layer 1*b* laminated on an outer surface of the base layer 1*a*, and a parting layer (surface layer) 1*c* laminated on an outer surface of the elastic layer 1*b*.

The heat generating layer 1*a* is a metal film of 10-70 μm in thickness, and the elastic layer 1*b* is molded with silicone rubber in a thickness of 0.1 mm to 0.3 mm so as to have a hardness of 20 degrees (JIS-A hardness under application of a load of 1 kg). On the elastic layer 1*b*, as the parting layer (surface layer) 1*c*, a fluorine-containing resin tube was coated in a thickness of 10 μm to 50 μm.

An AC magnetic flux is caused to act on the heat generating layer 1*a*, so that induced current is generated to generate heat (through electromagnetic induction heating).

This heat is conducted to the elastic layer 1*b* and the parting layer 1*c*, so that an entirety of the fixing sleeve 1 is heated and thus the recording material P passed and nip-fed through the fixing nip N is heated and pressed. Thus, the toner image T is fixed on the recording material P.

A mechanism for causing the AC magnetic flux to act on the heat generating layer 1*a* to generate heat will be described in detail with reference to FIG. 3.

The magnetic core 2 as a magnetic core material is disposed so as to penetrate through the hollow portion of the fixing sleeve 1 and is fixed by an unshown fixing means, so that a rectilinear open magnetic path having magnetic poles NP and SP is formed. That is, into the hollow portion of the fixing sleeve 1, the magnetic core 2 extending in a generatrix direction X of the fixing sleeve 1 is inserted. The magnetic core 2 does not form a loop outside the heat generating layer 1*a*, but forms the open magnetic path from which the magnetic path is partly disconnected. That is, the magnetic core 2 has a non-endless shape.

As a material for the magnetic core 2, a material having low hysteresis loss and high relative permeability may preferably be used. For example, it is preferable that ferromagnetic material constituted by high-permeability oxides and alloy materials selected from pure iron, electromagnetic steel plate, sintered ferrite, ferrite resin, dust core, amorphous alloy, and permalloy is used.

In this embodiment, sintered ferrite having a relative permeability of 1800 is used as the material for the magnetic core 2. The magnetic core 2 has a cylindrical shape of 5-30 mm in diameter, and is 340 mm in longitudinal length (longitudinal dimension).

Figure 4:
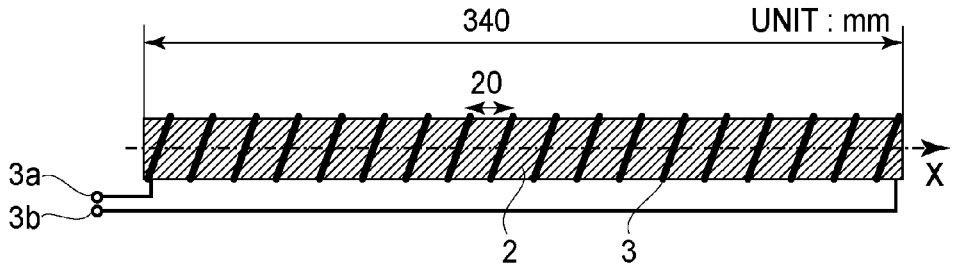
In FIG. 4, (a) is a schematic view showing a winding interval of an exciting coil, and (b) is a schematic view showing a magnetic field in the case where a current is passed through the exciting coil in an arrow direction.
Figure 4:
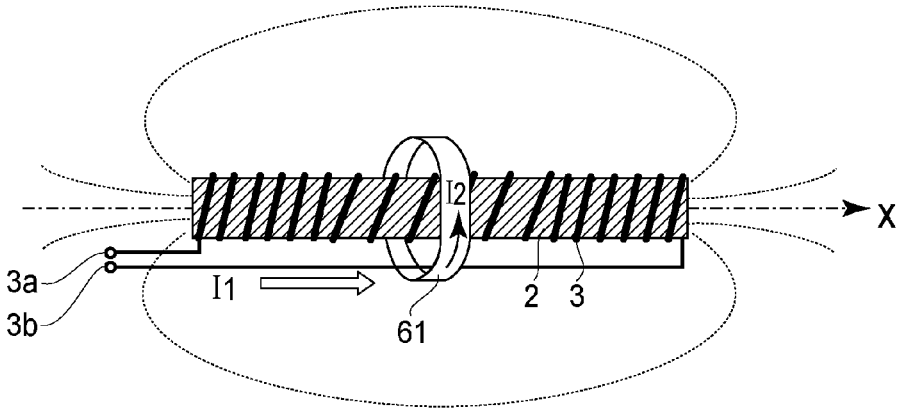

In FIG. 4, (a) is a schematic view for illustrating a manner of winding of the exciting coil 3. The exciting coil 3 is formed by helically winding an ordinary single lead wire around the magnetic core 2 at the hollow portion of the fixing sleeve 1. That is, the exciting coil 3 is wound around the magnetic core 2 directly or via another member such as a bobbin at the hollow portion with respect to a direction crossing a generatrix direction. The exciting coil 3 forms a helically shaped portion which is a helically wound portion, and the magnetic core 2 is provided inside the helically shaped portion.

In this embodiment, around the magnetic core 2 having the longitudinal dimension of 340 mm, the exciting coil 3 is wound 18 times at a uniform pitch of 20 mm as a winding interval. A high-frequency current (AC current) is passed through the exciting coil 3 via energization contact portions 3*a* and 3*b* by a high-frequency converter 16 (FIG. 3), so that magnetic flux (parallel to the generatrix direction of the fixing sleeve 1) is generated. The magnetic flux may only be required to extend in a direction along the generatrix direction of the fixing sleeve 1.

3. Printer Control

As shown in (a) of FIG. 2, temperature detecting elements 9, 10 and 11 for the fixing device A was provided in a side upstream of the fixing device A with respect to a direction in which the recording material P is fed into the image heating apparatus (fixing device) A. With respect to a longitudinal direction of the fixing sleeve 1, as shown in (b) of FIG. 2, the temperature detecting elements 9, 10 and 11 are disposed at positions opposing the fixing sleeve 1 at a central portion and end portions of the fixing sleeve 1 with respect to the longitudinal direction. Each of the temperature detecting elements is constituted by a non-contact thermistor. By a temperature control system using the temperature detecting elements, a temperature of the surface of the fixing sleeve 1 is maintained and adjusted to a predetermined target temperature.

Further, the temperature detecting elements 10 and 11 disposed in the neighborhood of the end portions of the fixing sleeve 1 can detect a degree of temperature rise in a so-called non-paper-passing region in which the recording material does not pass when the small-sized recording material is subjected to continuous printing.

Referring to a block diagram of a printer control portion 40 in FIG. 3, a printer controller (image processing portion) 41 effects communication and image data reception between itself and a host computer 42 as an external device. Then, the printer controller 41 develops the received image data into printable information (i.e., forms an image signal for image formation from the received image data). Further, with the development, the printer controller 41 effects transmission and reception of signals and signal communication between itself and an engine controller (control portion) 43.

The engine controller 43 effects transmission and reception of signals between itself and the printer controller 41, and controls units 44-46 of a printer engine including a fixing temperature controller 44, a frequency controller (frequency setting portion) 45 and an electric power controller 46 via the serial communication.

The fixing temperature controller 44 not only effects the temperature control of the fixing device A on the basis of temperatures detected by the temperature detecting elements 9, 10 and 11 but also detects abnormality of the fixing device A. The frequency controller 45 as the frequency setting portion effects control of a drive frequency of the high-frequency converter 16. The electric power controller 46 effects control of the electric power supplied to the high-frequency converter 16 by adjusting a voltage to be applied to the exciting coil 3. An operation of the frequency controller 45 in this embodiment will be described in detail in "8. Constitution of Embodiment 1" appearing hereinafter.

In a printer system including the printer controller 40 as described above, the host computer 42 sends image data to the printer controller 41. Further, the host computer 42 sets various printing conditions such as a recording material size for the printer controller 42 depending on demands from a user.

4. Heat Generation Principle

Figure 14:
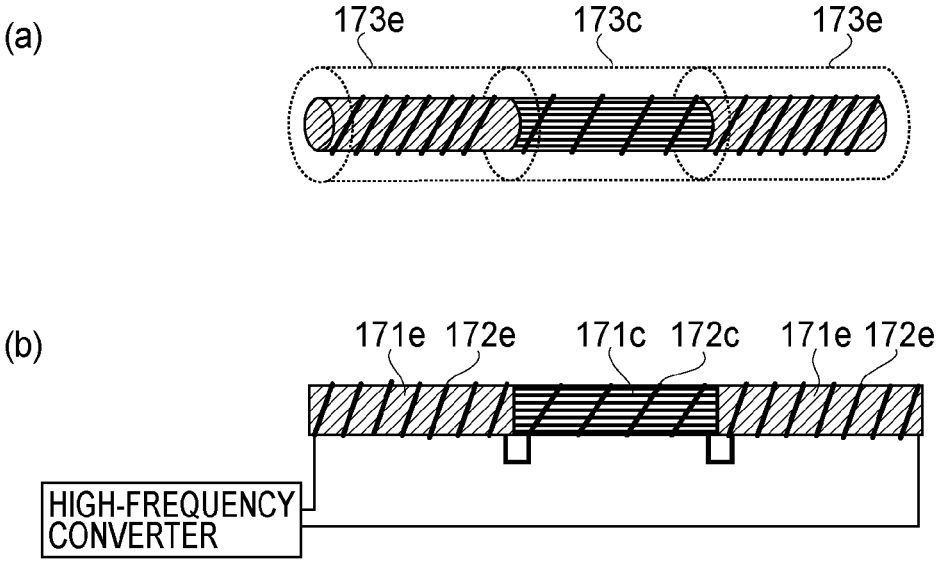
In FIG. 14, each of (a) and (b) is an arrangement view of a heat generating layer divided into three portions.

In FIG. 4, (b) is a schematic view sharing a magnetic field at the instant when the current increases in an arrow I1 direction in the exciting coil 3. the magnetic core 2 functions as a member for inducing the magnetic lines of force generated in the exciting coil 3 into the inside thereof to form a magnetic path. For that reason, the magnetic lines of force has a shape such that the magnetic lines of force concentratedly pass through the magnetic path and diffuse at the end portion of the magnetic core 2, and then are connected at portions far away from the outer peripheral surface of the magnetic core 2. In FIG. 14, such a connection state of the magnetic lines of force is partly omitted in some cases. A cylindrical circuit 61 having a small longitudinal width was provided so as to vertically surround this magnetic path. Inside the magnetic core 2, an AC magnetic field (in which a magnitude and a direction of the magnetic field repeat change thereof with time).

With respect to a circumferential direction of this circuit 61, the induced electromotive force is generated in accordance with the Faraday's law. The Faraday's law is such that the magnitude of the induced electromotive force generated in the circuit 61 is proportional to a ratio of a change in magnetic field penetrating through the circuit 61, and the induced electromotive force is represented by the following formula (1).

$$V = -N\frac{\Delta\Phi}{\Delta t} \quad (1)$$

V: inducted electromotive force

N: the number of winding of coil $\Delta\phi/\Delta t$: change in magnetic flux vertically penetrating through the circuit in a minute time $\Delta t$ It can be considered that the heat generating layer 1*a* is formed by connecting many short cylindrical circuits 61 with respect to the longitudinal direction. Accordingly, the heat generating layer 1*a* can be formed as shown in (a) of FIG. 5. When the current I1 is passed through the exciting coil 3, the AC magnetic field is formed inside the magnetic core 2, and the induced electromotive force is exerted over the entire longitudinal region of the heat generating layer 1*a* with respect to the circumferential direction, so that a circumferential direction current I2 indicated by broken lines flows over the entire longitudinal region.

The heat generating layer 1*a* has an electric resistance, and therefore the Joule heat is generated by a flow of this circumferential direction current I2. As long as the AC magnetic field is continuously formed inside the magnetic core 2, the circumferential direction current I2 is continuously formed while changing direction thereof. This is the heat generation principle of the heat generating layer 1*a* in the constitution of the present invention. Incidentally, e.g., in the case where the current I1 is a high-frequency AC current of 50 kHz in frequency, also the circumferential direction current I2 is the high-frequency AC current of 50 kHz in frequency.

As described above with reference to (a) of FIG. 5, I1 represents the direction of the current flowing into the exciting coil 3, and the induced current flows in the arrow I2 direction, which is a direction of canceling the AC magnetic field formed by the current I1, indicated by the broken lines in the entire circumferential region of the heat generating layer 1*a*.

Figure 5:
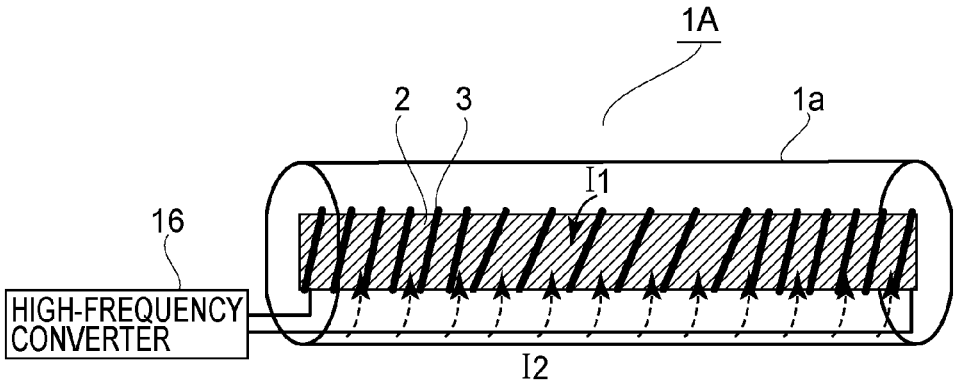
In FIG. 5, (a) is a schematic view showing a circumferential current flowing through a heat generating layer, and (b) is a schematic view showing magnetic coupling a coaxial transformer having such a shape that a primary coil and a secondary coil are wound.
Figure 5:
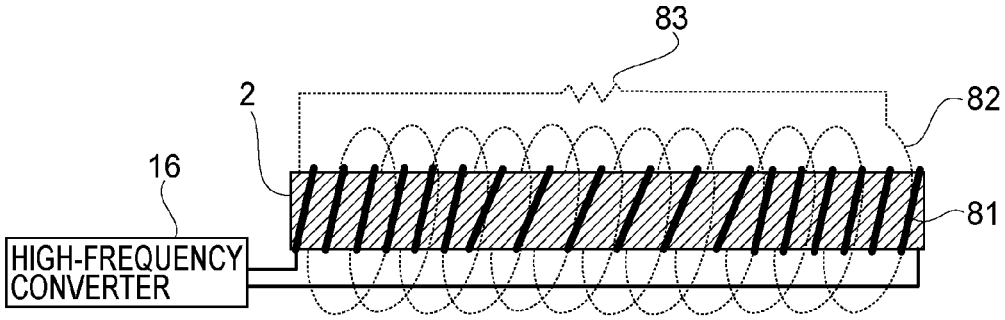

A physical model in which the current I2 is induced is, as shown in (b) FIG. 5, equivalent to the magnetic coupling of the coaxial transformer having a shape in which a primary coil 81 indicated by a solid line and a secondary coil 82 indicated by a dotted line.

The secondary winding 82 constituting the secondary coil forms a circuit in which a resistor 83 is included. By the AC voltage generated from the high-frequency converter 16, the high-frequency current generates in the primary winding (coil) 81, with the result that the induced electromotive force is exerted on the secondary winding 82, and thus is consumed as heat by the resistor 83. The Joule heat generated in the heat generating layer 1*a* is modeled as the secondary winding 82 and the resistor 83.

A constitution in which 70% or more, preferably 90% or more, of the magnetic flux coming out of one end of the magnetic core 2 passes through the outside of the heat generating layer 1*a* and then enters the other end of the magnetic core 2 is employed. By this constitution, a proportion of electric power consumed by the heat generating layer 1*a* to electric power supplied to the exciting coil 3 can be made 70% or more, preferably 90% or more. In addition, it is possible to suppress temperature rise of the exciting coil 3 or the like.

Figure 6:
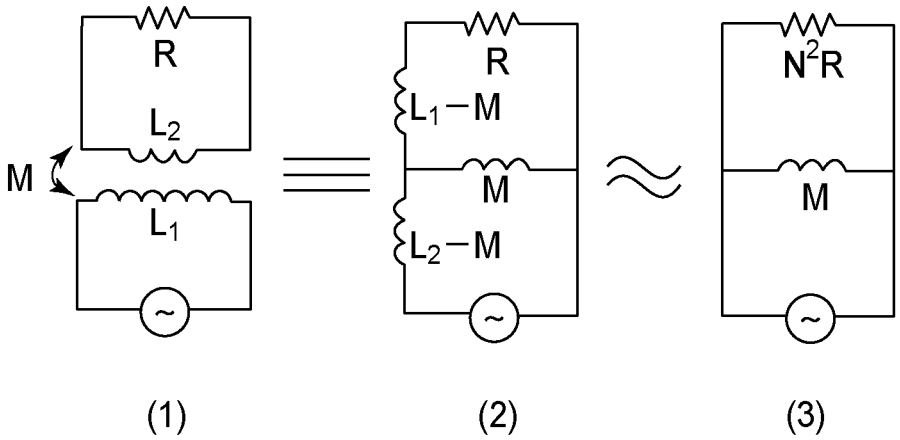
In FIG. 6, each of (a) and (b) shows an equivalent circuit.
Figure 6:
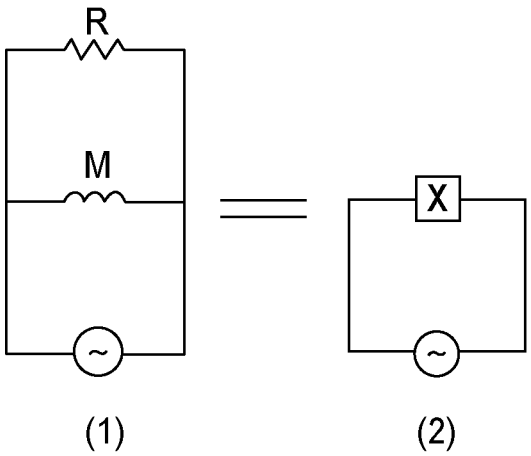

An equivalent circuit of the model view shown in (b) of FIG. 5 is shown in (1) of (a) of FIG. 6. In (a) of FIG. 6, L1 is an inductance of the primary winding 81 in (b) of FIG. 5, L2 is an inductance of the secondary winding 82 in (b) of FIG. 5, M is a mutual inductance between the primary winding 81 and the secondary winding 82, and R is the resistor 83. The equivalent circuit shown in (1) of (a) of FIG. 6 can be equivalently converted into an equivalent circuit shown in (2) of (a) of FIG. 6.

In order to consider a further simplified model, the case where the mutual inductance M is sufficiently large and L1, L2 and M are nearly equal to each other is assumed. In that case, (L1-M) and (L2-M) are sufficiently small. For that reason, the circuit of (2) of (1) of FIG. 6 can be approximated to an equivalent circuit shown in (3) of (a) of FIG. 6.

As described above, the constitution of the present invention shown in (a) of FIG. 5 will be considered as a replaced constitution represented by the approximated equivalent circuit shown in (3) of (a) of FIG. 6. First, the resistance will be described. In a state of (1) of (a) of FIG. 6, an impedance in the secondary side is the electric resistance R with respect to the circumferential direction of the heat generating layer 1*a*. In the transformer, the impedance in the secondary side is an equivalent resistance R' which is $N^2$ times (N: a winding number ratio of the transformer) that in the primary side.

Here, the winding number ratio N can be considered as N=18 by regarding the winding number for the heat generating layer 1*a* as one with respect to the winding number (18 in this embodiment) of the exciting coil 3 per the winding number of the winding in the primary side (heat generating layer 1*a*). Therefore, it can be considered that $R'=N^2R=18^2R$ holds, so that the equivalent resistance R shown in (3) of (a) of FIG. 6 becomes larger with a larger winding number.

In (2) of (b) of FIG. 6, a synthetic impedance X is defined, and the above equivalent circuit is further simplified. This simplified equivalent circuit will be used in explanation described later. When the synthetic impedance X is obtained, the following formula (2) is obtained.

$$\frac{1}{X} = \frac{1}{R'} + \frac{1}{j\omega M}, \ (\omega = 2\pi f) \quad (2)$$

$$|X| = \frac{1}{\sqrt{\left(\frac{1}{R'}\right)^2 + \left(\frac{1}{\omega M}\right)^2}}$$

5. Cause of Lowering in Heat Generation Amount in the Neighborhood of Magnetic Core End Portions The problem that the heat generation amount lowers in the neighborhood of the magnetic core end portions, and thus heat generation non-uniformity generates with respect to the longitudinal direction will be specifically described. As shown in (a) of FIG. 7, the magnetic core 2 forms a rectilinear open magnetic path having magnetic poles NP and SP, and is 340 mm in longitudinal length. In this embodiment, the length of the magnetic core 2 is equal to the length of the fixing sleeve 1.

Figure 7:
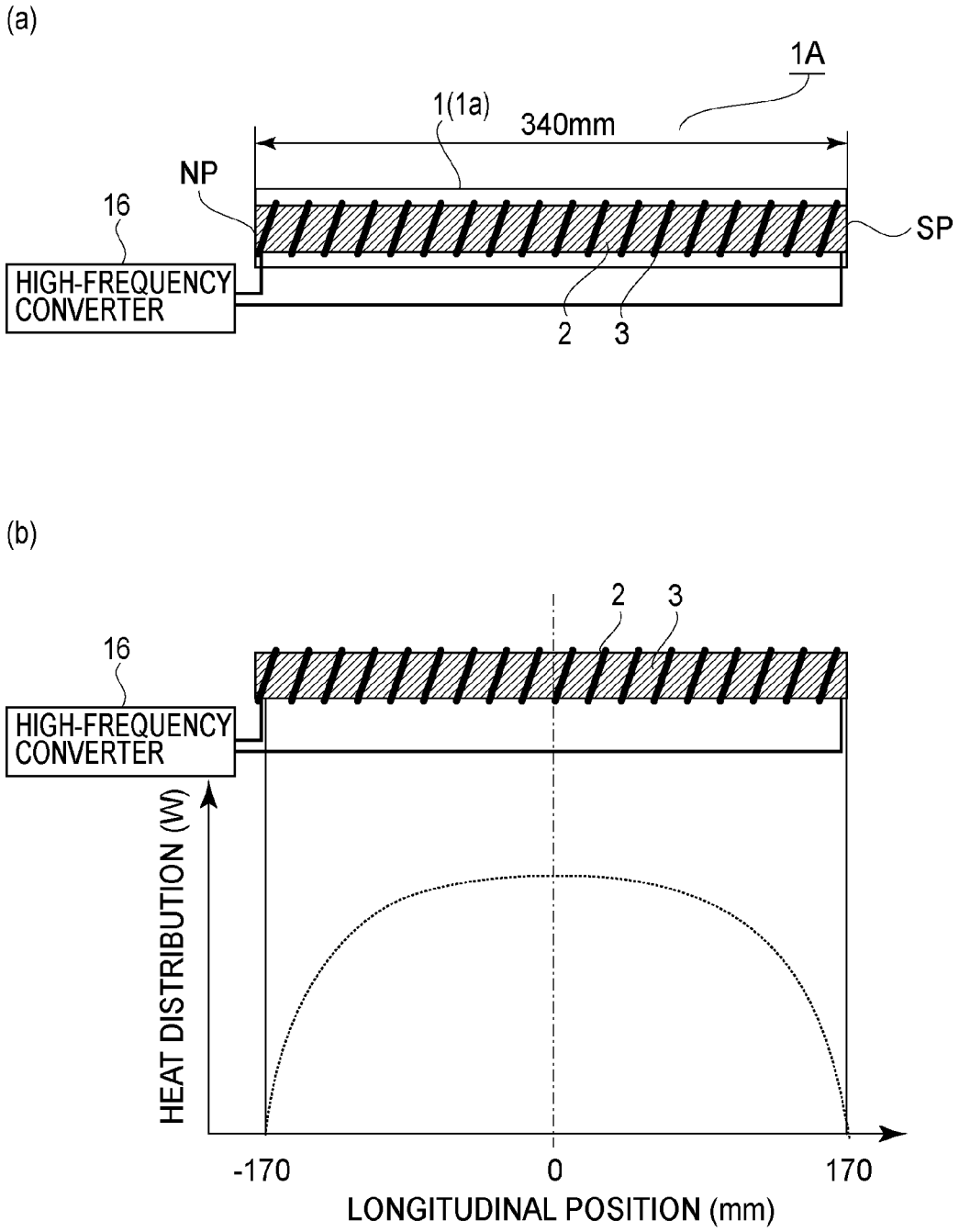
In FIG. 7, (a) is a schematic view showing the winding interval of the exciting coil, and (b) is a graph showing a heat generation distribution.

In the constitution in this embodiment, although the downsizing can be realized by employing the open magnetic path, the heat generation amount lowers in the neighborhood of the end portions of the magnetic core 2 as shown in (b) of FIG. 7, so that the problem such that the heat generation non-uniformity generates with respect to the longitudinal direction. When the heat generation non-uniformity generates, at a portion where the heat generation amount is small, improper fixing of the toner is caused, and thus excessive fixing is made at a portion where the heat generation amount is large, so that image defect is caused. The reason why the heat generation non-uniformity generates with respect to the longitudinal direction of the fixing sleeve 1 is naturally associated largely with the formation of the open magnetic path by the magnetic core 2. Specifically, the following factors 5-1) and 5-2) are associated with the generation of the heat generation non-uniformity.

5-1) Decrease in apparent permeability at magnetic core end portions.

5-2) Decrease in synthetic impedance at magnetic core end portions

Hereinafter, details will be described.

5-1) Decrease in Apparent Permeability at Magnetic Core End Portions

Figure 8:
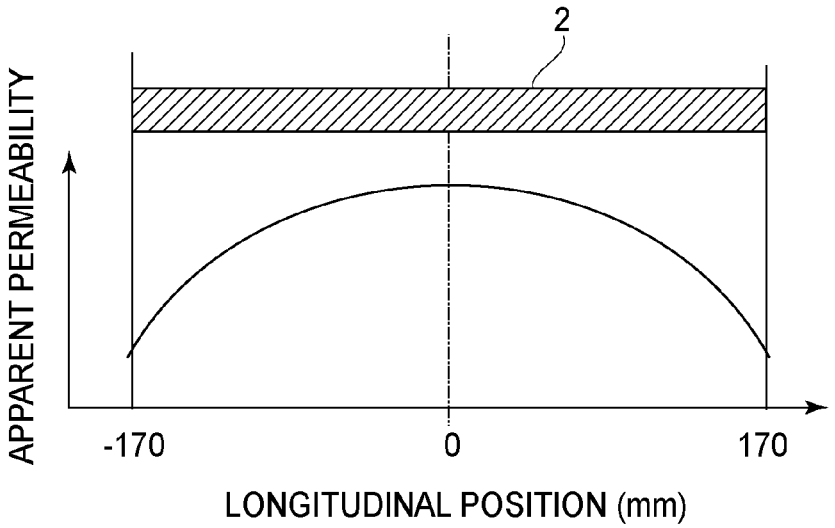
In FIG. 8, (a) is a schematic view for illustrating a phenomenon that an "apparent permeability μ" is lowered at magnetic core end portions, and (b) is a schematic view showing a shape of magnetic flux in the case where ferrite and air are provided in a uniform magnetic field.
Figure 8:
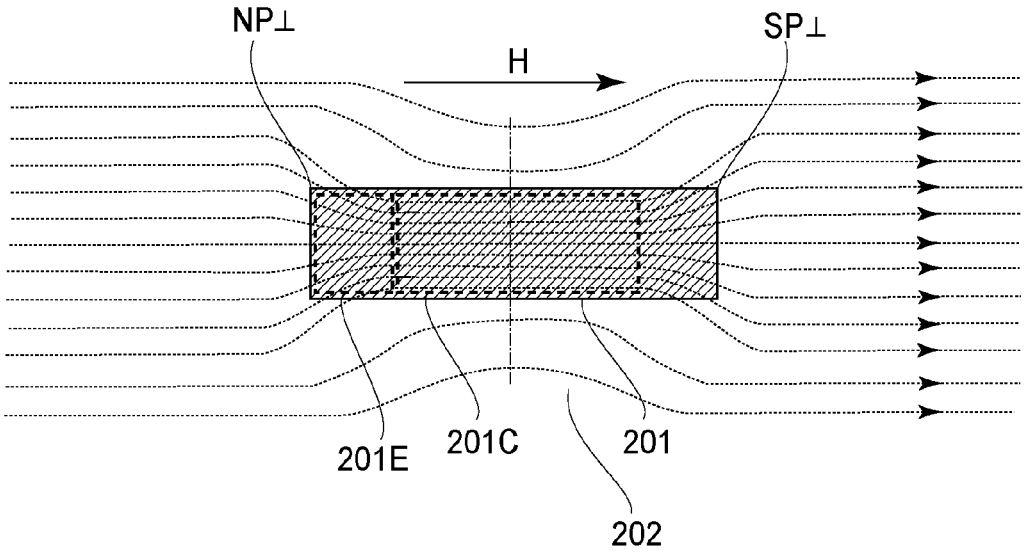

In FIG. 8, (a) is a conceptual drawing for illustrating a phenomenon that apparent permeability μ is lower at the end portions than at the central portion of the magnetic core 2. The reason why this phenomenon generates will be described specifically.

In a uniform magnetic field H, space magnetic flow density B in a magnetic field region such that magnetization of an object is substantially proportional to the external magnetic field is represented by the following formula (3).

$$B=\mu H \tag{3}$$

That is, when a substance having high member μ is placed in the magnetic field H, it is possible to create the magnetic flow density B having a height ideally proportional to a height of the permeability. In the present invention, this space in which the magnetic flow density is high is used as the magnetic path. Particularly, the magnetic path is formed as a closed magnetic path in which the magnetic path itself is formed in a loop or as an open magnetic path in which the magnetic path is interrupted by providing an open end or the like. In the present invention, the open magnetic path is used as a feature.

In FIG. 8, (b) shows a shape of magnetic flux in the case where ferrite 201 and air 202 are disposed in the uniform magnetic field H. The ferrite 201 has the open magnetic path, relative to the air 202, having boundary surfaces NP⊥ and SP⊥ perpendicular to the magnetic lines of force. In the case where the magnetic field H is generated in parallel to the longitudinal direction of the magnetic core, the magnetic lines of force is, as shown in FIG. 14, such that the density is low in the air 202 and is high at a central portion 201C of the magnetic core. Further, compared with the central portion 201C, the magnetic flow density is low at an end portion 201E of the magnetic core.

The reason why the magnetic flux density becomes small at the end portion of the magnetic core is based on a boundary condition between the air 202 and the ferrite 201. At the boundary surfaces NP⊥ and SP⊥ perpendicular to the magnetic lines of force, the magnetic flow density is continuous, and therefore the magnetic flow density is high at an air portion contacting the ferrite in the neighborhood of the boundary surface and is low at the ferrite end portion 201E contacting the air. As a result, the magnetic flow density at the ferrite end portion 201E becomes small. This phenomenon looks as if the end portion permeability decreases. For that reason, in the present invention, the phenomenon is expressed as "Decrease in apparent permeability at magnetic core end portions".

This phenomenon can be verified indirectly using an impedance analyzer.

Figure 9:
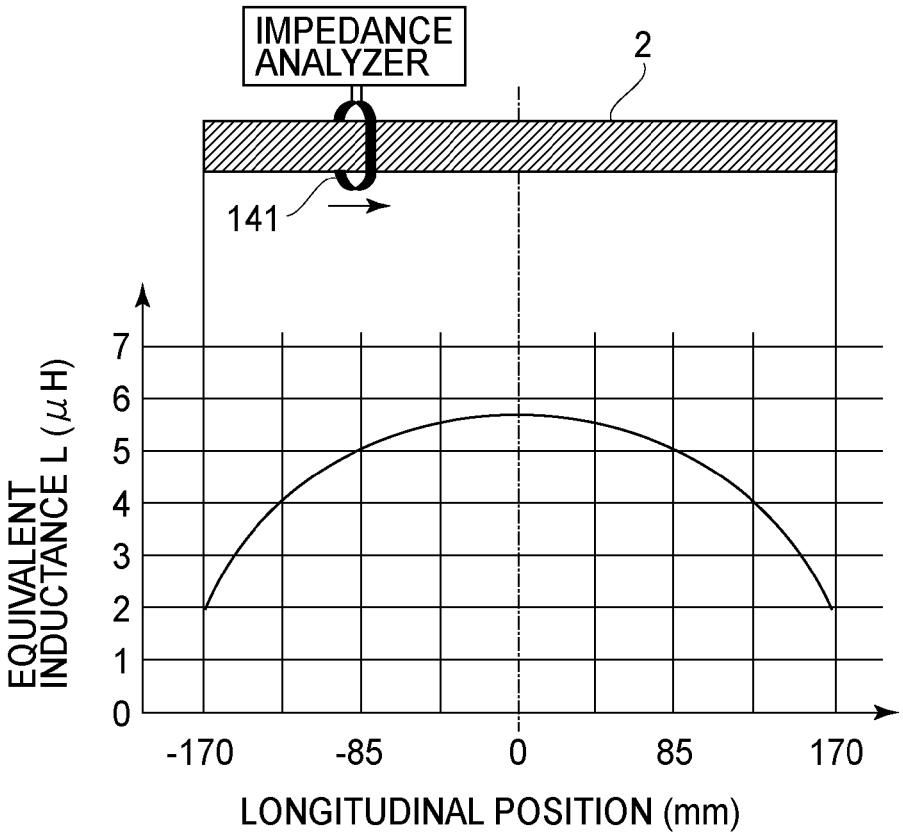
FIG. 9 is a schematic view for illustrating scanning a magnetic core with a coil.
Figure 15:
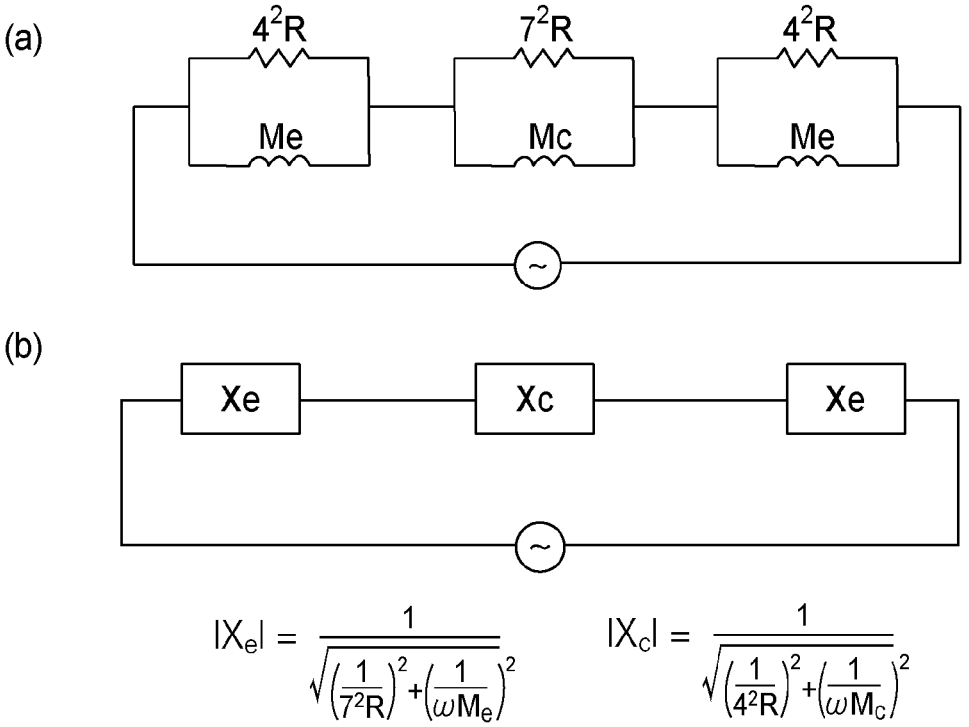
In FIG. 15, each of (a) and (b) shows an equivalent circuit.

In FIG. 9, the magnetic core 2 is inserted into a coil 141 (winding number N: 5) of 30 mm in diameter, and scanning with the coil 141 is made with respect to an arrow direction. In this case, the coil 141 is connected with the impedance analyzer at both ends thereof. When an equivalent inductance L (frequency: 50 kHz) from the both ends of the coil is measured, a mountain-shape distribution as shown in the graph in FIG. 15 is obtained. The equivalent inductance L at each of the end portions of the magnetic core 2 is attenuated to ½ or less of that at the central portion.

The equivalent inductance L is represented by the following formula (4).

$$L=\mu N2S/\underline{l} \tag{4}$$

In the formula (4), μ is the magnetic core permeability, N is the winding number, $\underline{l}$ is the length of the coil, and S is a cross-sectional area of the coil. The shape of the coil 141 is unchanged, and therefore in this experiment, the parameters S, N and $\underline{l}$ are unchanged. Accordingly, the mountain-shaped distribution is caused by "Decrease in apparent permeability at member end portions".

In summary, the phenomenon of "Decrease in apparent permeability at magnetic core end portions" appears by forming the magnetic core 2 so as to have the open magnetic path.

Figure 10:
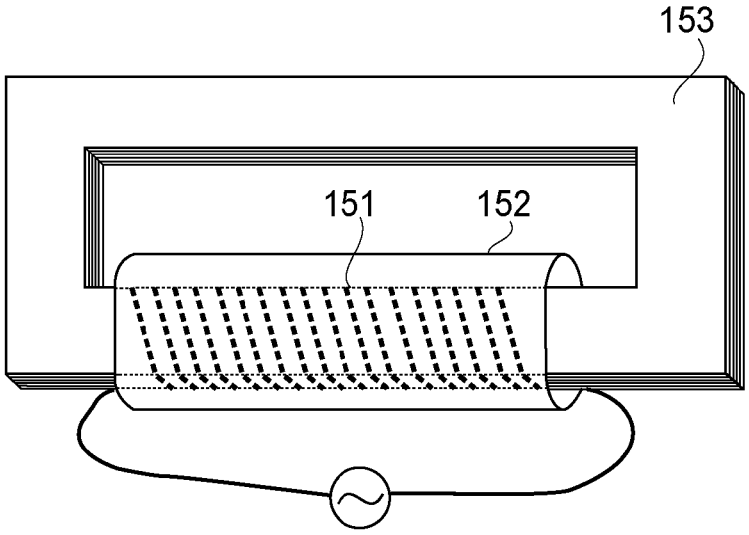
FIG. 10 is an illustration in the case where a closed magnetic path is formed.

In the case of the closed magnetic path, the above phenomenon does not appear. The case of the closed magnetic path as shown in FIG. 10 will be described.

A magnetic core 153 forms a loop outside an exciting coil 151 and a heat generating layer 152, so that the closed magnetic path is formed. In this case, different from the above-described case of the open magnetic path, the magnetic lines of force pass through only the inside of the closed magnetic path, there are no boundary surfaces (NP⊥ and SP⊥ in (b) of FIG. 8) perpendicular to the magnetic lines of force. Accordingly, it is possible to form uniform magnetic flow density over an entirety of the inside of the magnetic core 153 (i.e., over a full circumference of the magnetic path).

5-2) Decrease in Synthetic Impedance at Magnetic Core End Portions

Figure 11:
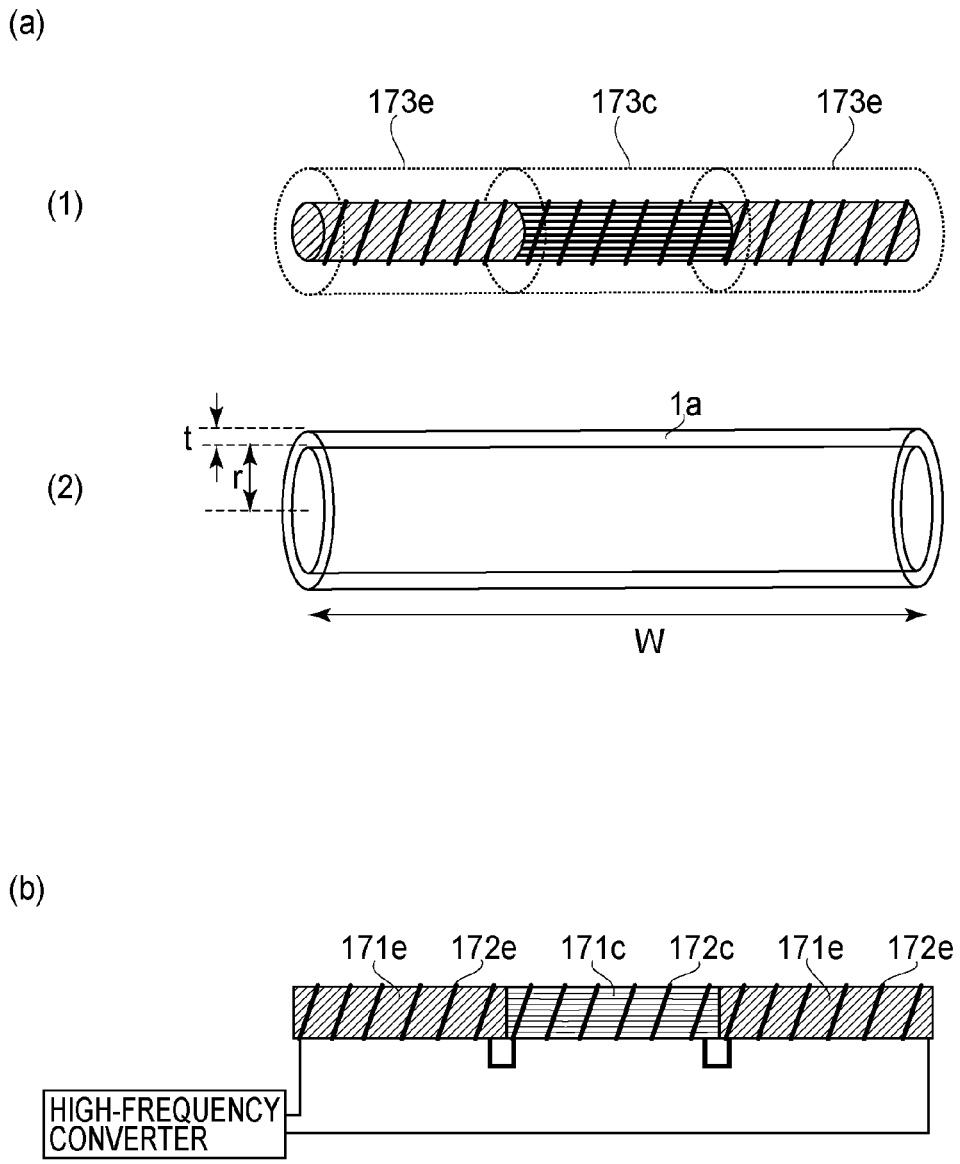
In FIG. 11, each of (a) and (b) is an arrangement view of a heat generating layer divided into three portions.

In this constitution, the apparent permeability has a distribution with respect to the longitudinal direction. In order to explain this phenomenon by using a simple model, description will be made using a constitution shown in (a) and (b) of FIG. 11. In (1) of (a) of FIG. 11, compared with the constitution shown in FIG. 7, the magnetic core and the heat generating layer are divided into three portions with respect to the longitudinal direction. The heat generating layer includes, as shown in (1) of (a) of FIG. 11, two end portions 173*e* and a central portion 173*c* which have the same shape and the same physical property. A resistance value of each end portion 173*e* with respect to the circumferential direction is Re, and a resistance value of the central portion 173*c* with respect to the circumferential direction is Rc.

The circumferential direction resistance means a resistance value in the case where a current path is formed with respect to the circumferential direction of the cylinder. When the resistance with respect to the circumferential direction is R, as shown in (2) of (a) of FIG. 11, the resistance R can be represented by the following formula in the case where the heat generating layer 1*a* is ρ in volume resistivity, t in thickness, r in radius and w in longitudinal length.

$$R=\rho 2\pi r/tw$$

The circumferential direction resistance is the same value, i.e., Re=Rc (=R). The magnetic core includes the two end portions 171*e* (permeability: μe) and the central portion 171*c* (permeability: μc) which have the same longitudinal dimension of 80 mm. Values of the permeability of the end portion 171*e* and the central portion 171*c* satisfy the relationship of: μe (end portion)<μc (central portion). In order to consider the above-described phenomenon based on a simple physical model to the possible extent, a change in individual apparent permeability at the inside of each of the end portion 171*e* and the central portion 171*c* is not considered.

The winding is, as shown in (b) of FIG. 11, such that the winding number Ne of each of two exciting coils 172*e* and an exciting coil 172*c* is 6. Further, the exciting coils 172*e* and the exciting coil 172*c* are connected in series. Further, an interaction between the exciting coils at the end portion 171*e* and the central portion 171*c* is sufficiently small, so that the above-described divided three circuits can be modeled as three branched circuits as shown in (a) of FIG. 12. The permeability values of the exciting coils satisfy the relationship of: μe<μc, and therefore a relationship of the mutual inductance is also Me<Mc. A further simplified model is shown in (b) of FIG. 12.

When an equivalent resistance of each of the circuits is seen from the primary side, $R'=6^2R$ holds at the end portions and $R'=6^2R$ holds at the central portion. Therefore, when synthetic impedances Xe and Xc are obtained, Xe and Xc are represented by the following formulas (5) and (6).

$$|X_e| = \frac{1}{\sqrt{\left(\frac{1}{6^2R}\right)^2 + \left(\frac{1}{\omega M_e}\right)^2}} \tag{5}$$

$$|X_c| = \frac{1}{\sqrt{\left(\frac{1}{6^2R}\right)^2 + \left(\frac{1}{\omega M_c}\right)^2}} \tag{6}$$

Figure 12:
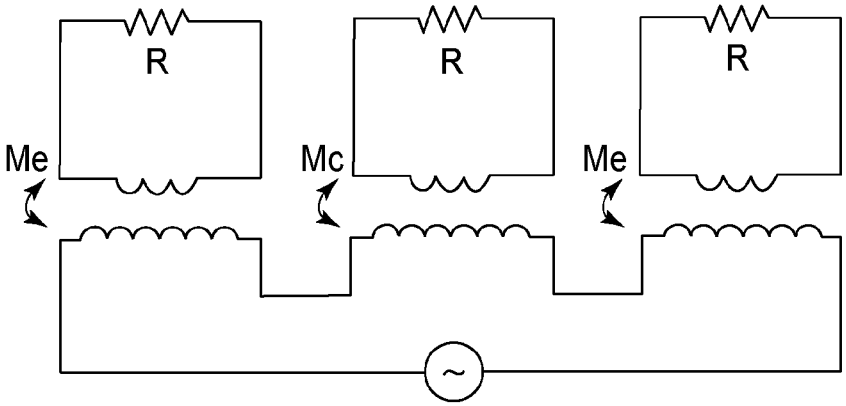
In FIG. 12, each of (a) to (c) shows an equivalent circuit.
Figure 12:
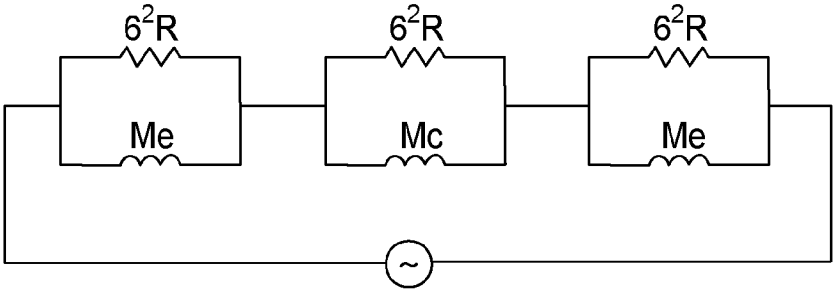
Figure 12:
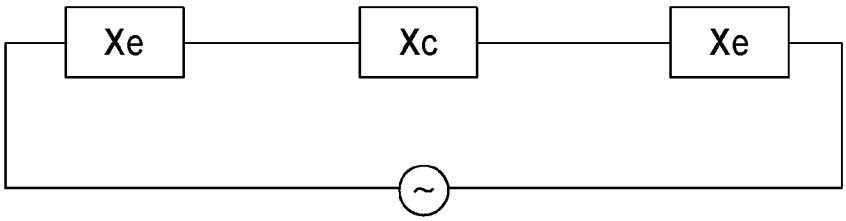
Figure 13:
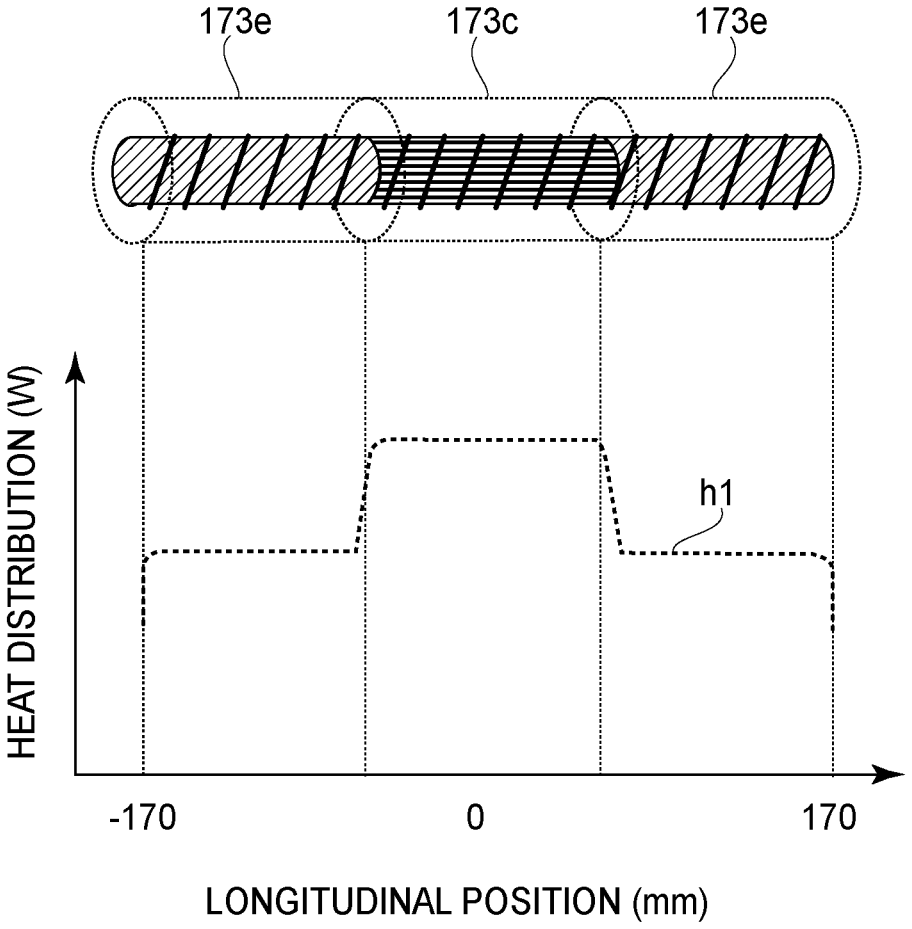
FIG. 13 is a schematic view showing a heat generation amount at a central portion and end portions.

When a parallel circuit portion of R and L is replaced with the synthetic impedance X, an equivalent circuit as shown in (c) of FIG. 12 is obtained. In (c) of FIG. 12, the relationship of the mutual inductance is Me<Mc, and therefore Xe<Xc holds. In the case where the AC voltage is applied from the high-frequency converter, in a series circuit of Xe and Xc shown in (c) of FIG. 12, a magnitude relationship of the heat generation amount is determined by the magnitude relationship between Xe and Xc, and therefore the magnitude relationship of the heat generation amount is Qe<Ac. Therefore, when the AC current is passed through the exciting coil 3, as shown by hl in FIG. 13, a mountain-shaped distribution such that the heat generation amount at each of the end portions 173*e* of the heat generating layer is small and the heat generation amount at the central portion 173*c* of the heat generating layer is large is obtained.

In the above model, the magnetic core is divided into three portions with respect to the longitudinal direction in order to explain the above-described phenomenon in a simple manner, but in an actual constitution shown in (a) of FIG. 7, the change in apparent permeability continuously generates. Further, the interaction or the like between the inductances with respect to the longitudinal direction would be considered, and therefore a complicated circuit is formed. However, "Reason why heat generation amount lowers in the neighborhood of magnetic core end portions" is described above.

6. Factor Influencing Heat Generation Distribution in Longitudinal Direction

As a method of changing a longitudinal heat generation distribution of the heat generating layer 1*a*, the following two methods 6-1) and 6-2) will be described.

6-1) Manner of Winding of Exciting Coil 3

In this embodiment, the case where the number of winding of the exciting coil 3 is made dense (large) at the end portions of the magnetic core 2 and sparse (small) at the central portion of the magnetic core 2 will be described. With respect to the central portion and the end portions, it is possible to change a balance between the inductance and the resistance by charging the manner of winding of the exciting coil 3. This will be described using the above-described model in which the magnetic core and the heat generating layer are divided into the three portions with respect to the longitudinal direction.

As shown in (a) and (b) of FIG. 14, at each of the end portions 171*e* of the magnetic core, the exciting coil 172*e* is wound in the winding number Ne=7, and at the central portion 171*c* of the magnetic core, the exciting coil 172*c* is wound in the winding number Nc=4. Other constitutions are the same as those in the model of (1) of (a) of FIG. 11. A simplified model view is shown in (a) of FIG. 15.

When an equivalent resistance of each of the divided three circuits is seen from the primary side, $R'=7^2R$ holds at the end portions and $R'=4^2R$ holds at the central portion. Therefore, when synthetic impedances Xe and Xc are obtained, Xe and Xc are represented by the following formulas (7) and (8).

$$|X_e| = \frac{1}{\sqrt{\left(\frac{1}{7^2R}\right)^2 + \left(\frac{1}{\omega M_e}\right)^2}} \tag{7}$$

$$|X_c| = \frac{1}{\sqrt{\left(\frac{1}{4^2R}\right)^2 + \left(\frac{1}{\omega M_c}\right)^2}} \tag{8}$$

When a parallel circuit portion of R and L is replaced with the synthetic impedance X, an equivalent circuit as shown in (b) of FIG. 15 is obtained. In this way, by adjusting the winding manner of the exciting coil 3 as the method of charging the longitudinal heat generation distribution of the heat generating layer 1*a*, a balance between Xe and Xc, i.e., a balance between Qe and Qc can be charged.

6-2) f/R

From the formulas (5) and (6), satisfaction of Xe<Xc was described. Here, a condition in which the heat generation distribution becomes uniform, i.e., Xe is nearly equal to Xc will be considered. Assuming that Xe=Xc holds, i.e., that the right sides of the formulas (5) and (6) are equal to each other, when the formulas are reformatted, the following relational expression (9) holds.

$$1 + \left(\frac{6^2R}{\omega Mc}\right)^2 = 1 + \left(\frac{6^2R}{\omega Me}\right)^2 \tag{9}$$

The formula (9) holds if Me=Mc is satisfied, but does not hold in general since Me<Mc is satisfied as described above. However, when R/ω approaches 0 without limit, the formula (9) holds.

In other words, with a larger f/R, Xe=Xc tends to hold, i.e., the longitudinal heat generation distribution approaches uniform. Here, f is the frequency of the AC magnetic field, and $\omega=2\pi f$ holds. Further, R is the circumferential direction resistance described above.

Next, in order to check whether or not the longitudinal heat generation distribution of the heat generating layer 1*a* is determined, conditions under which an experiment is conducted are shown in Table 1.

TABLE 1

| | No. | | | | | | |
|---|---|---|---|---|---|---|---|
| | WR*1 | T*2 | R*3 | L*4 | CDR*5 | F*6 | f/R |
| | SYMBOL | | | | | | |
| | ρ | t | r | w | R | f | f/R |
| | UNIT | | | | | | |
| | Ω/cm | μm | mm | mm | mΩ | kHz | kHz/mΩ |
| 1 | 8.45E−7 | 35 | 12 | 340 | 5.41 | 46 | 8.5 |
| 2 | 8.45E−8 | 35 | 12 | 340 | 0.54 | 46 | 85.2 |
| 3 | 4.00E−7 | 35 | 12 | 340 | 2.56 | 46 | 18.0 |
| 4 | 8.45E−7 | 70 | 12 | 340 | 2.7 | 46 | 17.0 |
| 5 | 8.45E−7 | 70 | 12 | 340 | 2.7 | 92 | 34.1 |
| 6 | 4.00E−7 | 70 | 12 | 340 | 1.28 | 46 | 35.9 |
| 7 | 4.00E−7 | 70 | 12 | 340 | 1.28 | 92 | 71.9 |
| 8 | 8.45E−8 | 70 | 12 | 340 | 0.27 | 46 | 170.4 |
| 9 | 8.45E−7 | 35 | 18 | 340 | 8.11 | 46 | 5.7 |
| 10 | 8.45E−7 | 35 | 18 | 340 | 8.11 | 92 | 11.3 |

*1"VR" is the volume resistance.
*2"T" is the thickness of the heat generating layer 1a.
*3"R" is the radius of the heat generating layer 1a.
*4"L" is the longitudinal length of the heat generating layer 1a.
*5"CDR" is the circumferential direction resistance of the heat generating layer 1a.
*6"F" is the frequency.

Figure 16:
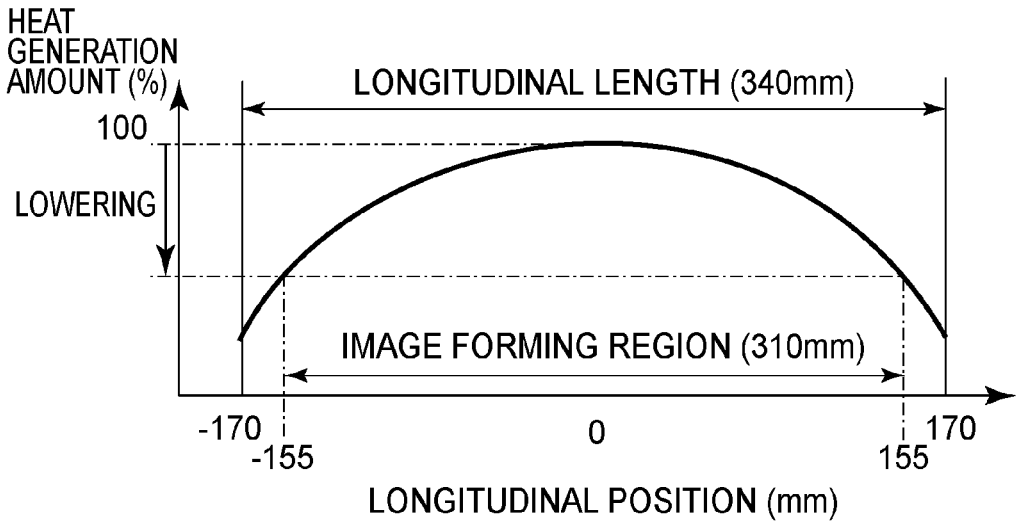
FIG. 16 is a graph for illustrating an end portion heat generation lowering amount.

As a result, the longitudinal heat generation distribution of the heat generating layer 1*a* is obtained as shown in, e.g., FIG. 16, In FIG. 16, the heat generation amount at the longitudinal central portion of the heat generating layer 1*a* is highest, and a distribution when the highest heat generation amount is taken as 100% is shown. Hereinafter, as an index for indicating whether or not the longitudinal heat generation distribution of the heat generating layer 1*a*, the end portion heat generation lowering amount is used. The end portion heat generation lowering amount represents what degree of a lowering in heat generation amount at an extreme end portion (position of 155 mm from the longitudinal center) of the image forming region of the fixing sleeve 1 in this embodiment from the heat generation amount (100%) at the longitudinal center of the sleeve 1. That is, with a smaller end portion heat generation lowering amount, the longitudinal heat generation amount of the heat generating layer 1*a* is uniform.

Figure 17:
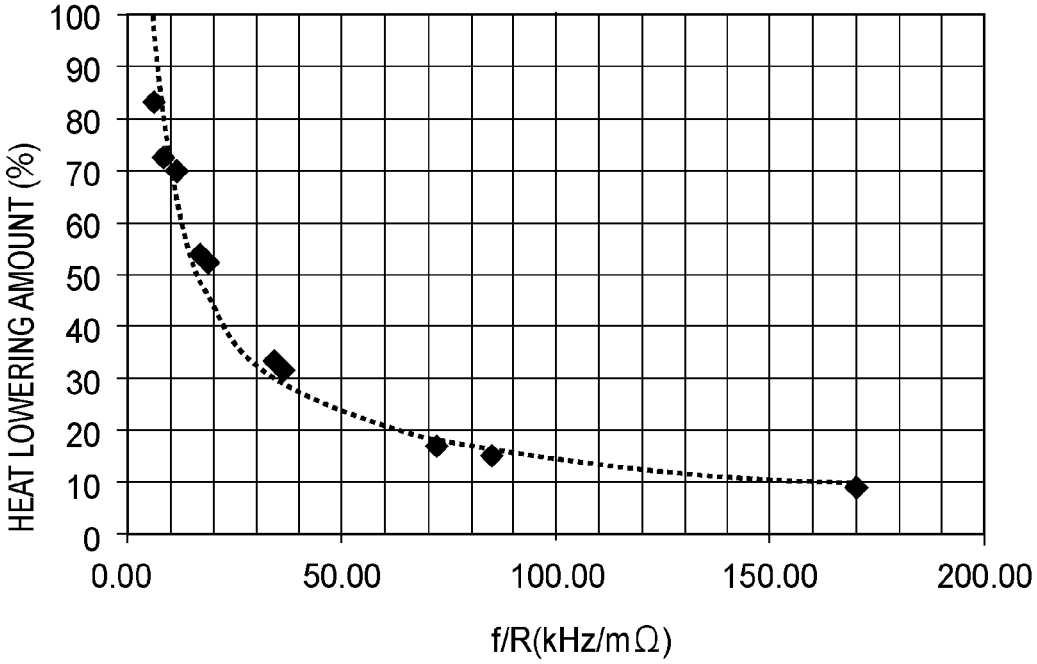
FIG. 17 is a graph showing a relationship between f/R and a heat generation distribution.

A graph in which the end portion heat generation lowering amount is plotted under each of the conditions shown in Table 1 is shown in FIG. 17. As shown in FIG. 17, with a larger value of f/R, the end portion heat generation lowering amount becomes smaller. Thus, it was able to be confirmed that the longitudinal heat generation distribution is determined by the value of f/R.

In this embodiment, for convenience, the condition is changed while fixing the longitudinal length of the heat generating layer 1*a* as shown in Table 1, but a relationship between f/R and the end portion heat generation lowering amount is unchanged even when the longitudinal length of the heat generating layer 1*a* is changed. This is confirmed by an experiment by the present inventors.

Further, this phenomenon can occur only in the case where members including the air and the magnetic core 2 which are extremely different in permeability are disposed in the magnetic field region and which have the boundary surfaces perpendicular to the magnetic lines of force. For that reason, in the case where a constitution of a blank core consisting only of the exciting coil 3 with no magnetic core 2 is employed, different from the above phenomenon, the apparent permeability is unchanged. Accordingly, a dependency of the heat generation distribution on f/R does not appear. According to the experiment by the present inventors, the relationship between f/R and the end portion heat generation lowering amount obtained in FIG. 17 was not satisfied when the permeability of the magnetic core 2 is 100 or less.

7. Influence of TCR (Temperature Coefficient of Resistance) of Heat Generating Layer (PTC Characteristic)

Figure 18:
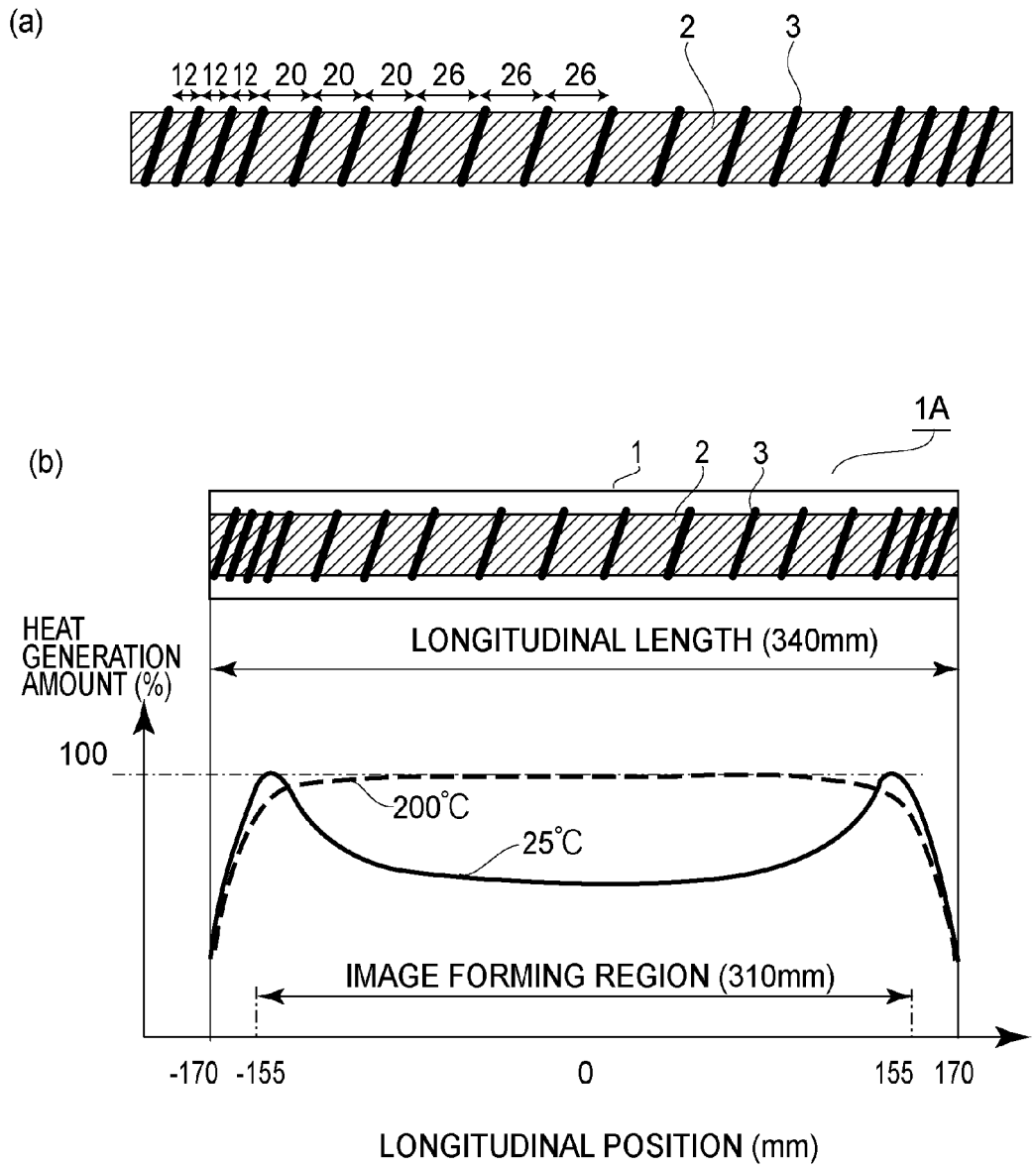
In FIG. 18, (a) is a schematic view showing a winding manner of an exciting coil, and (b) is a schematic view for illustrating a heat generation distribution.

As described above, in order to uniformize the longitudinal heat generation distribution of the heat generating layer 1*a*, the manner of winding of the exciting coil 3 has to be changed depending on the value of f/R. In this embodiment, f/R=17.0 (kHz/mΩ) is set, and the exciting coil 3 is wound as shown in (a) of FIG. 18 so as to uniformly generate heat at 200° C. which is a control temperature.

On the other hand, in the case where the TCR of the heat generating layer 1*a* is not zero, the circumferential direction resistance R changed depending on the temperature as shown in the following formula (10).

$$R=R0(1+\mathrm{TCR}\times\Delta T) \tag{10}$$

R0: Circumferential direction resistance at reference temperature (e.g., at room temperature)

ΔT: Degree of change in temperature

For that reason, also the f/R changes depending on the temperature change, and thus the change in f/R means that the heat generation distribution changes. Particularly, during rising (warm-up) o the fixing device A in which the degree of the temperature change of the heat generating layer 1*a* is large, the temperature change generates in a large degree from the room temperature to the control temperature, and therefore also the heat generation distribution in this rising period largely changes as shown in (b) of FIG. 18. In (b) of FIG. 18, the case where the TCR is positive (PTC characteristic) is shown. In the case where the TCR is positive, the heat generation amount at the end portion is large in the rising period, and therefore the temperature distribution of the fixing sleeve 1 immediately after the rising is such that the end portion temperature is high.

Figure 19:
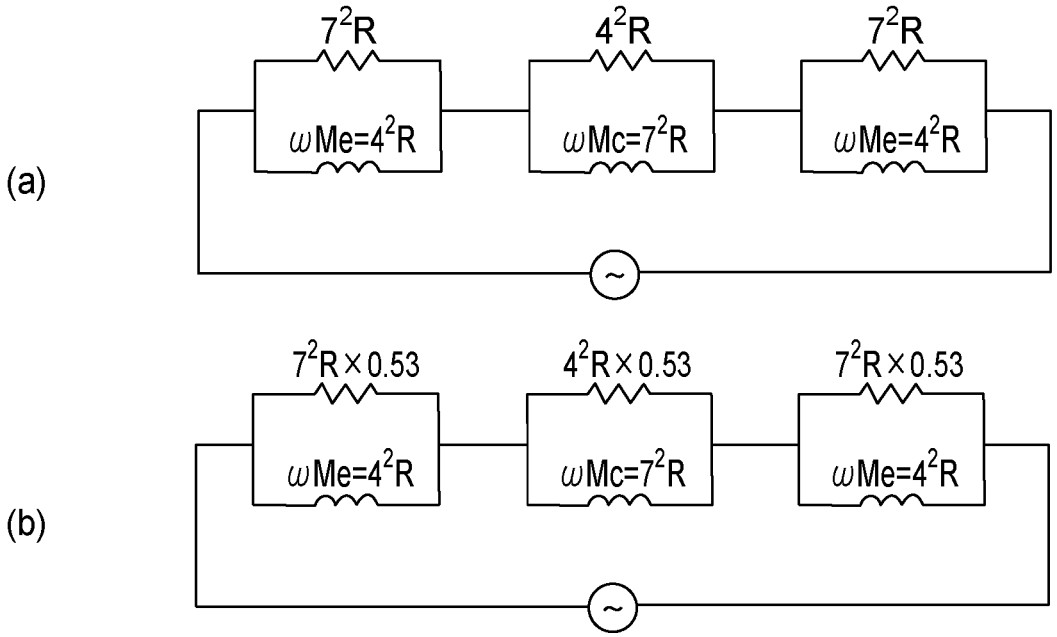
In FIG. 19, each of (a) and (b) shows an equivalent circuit.

The reason why the heat generation amount at the end portion is large will be described. Description will be described using the equivalent circuit in the model in which the circuit is divided into three portions with respect to the longitudinal direction as shown in (b) of FIG. 12 used for illustrating the heat generation amounts at the end portions and the central portion. In FIG. 19, (a) and (b) are equivalent circuits in the case where the exciting coil 3 is wound densely at the end portions. In this case, the exciting coil 3 is wound 7 times at the end portions and is wound 4 times at the central portion. In FIG. 19, (a) shows a state of 200° C. which is the control temperature and a state in which heat is generated uniformly. For that reason, in order to simplify calculation, the following equations are used.

$$\omega Me=4^2R$$

$$\omega Mc=7^2R$$

In these equivalent circuits, the impedance is the same at the end portions and the central portion, and therefore heat is generated uniformly.

In this embodiment, as the heat generating layer 1*a*, the metal film of 2.7 mΩ in circumferential direction resistance R at room temperature of 25° C. and 5000 ppm/° C. in TCR is used. At 200° C. which is the control temperature, the circumferential direction resistance R of the heat generating layer 1*a* is 5.1 mΩ. For that reason, at the room temperature of 25° C., the circumferential direction resistance R is 0.53 time the circumferential direction resistance R at the control temperature of 200° C.

In FIG. 19, (b) is the equivalent circuit in a state of the room temperature of 25° C. In this case, when synthetic impedances Xe and Xc at the end portions and the central portion are calculated similarly as in the formulas (5) and (6), the following formulas (11) and (12) are obtained.

$$|X_e| = \frac{1}{\sqrt{\left(\frac{1}{7^2R\times 0.53}\right)^2+\left(\frac{1}{4^2R}\right)^2}} = 13.6\ R \tag{11}$$

$$|X_c| = \frac{1}{\sqrt{\left(\frac{1}{4^2R\times 0.53}\right)^2+\left(\frac{1}{7^2R}\right)^2}} = 8.4\ R \tag{12}$$

From the formulas (11) and (12), the end portion impedance Xe is larger than the central portion impedance Xc, and therefore the heat generation amount at the end portions at the room temperature of 25° C. is higher than the heat generation amount at the central portion. Similarly, also in a period of 25° C.-200° C., the end portion heat generation amount is higher than the central portion heat generation amount.

8. Frequency Control of Embodiment 1

Figure 20:
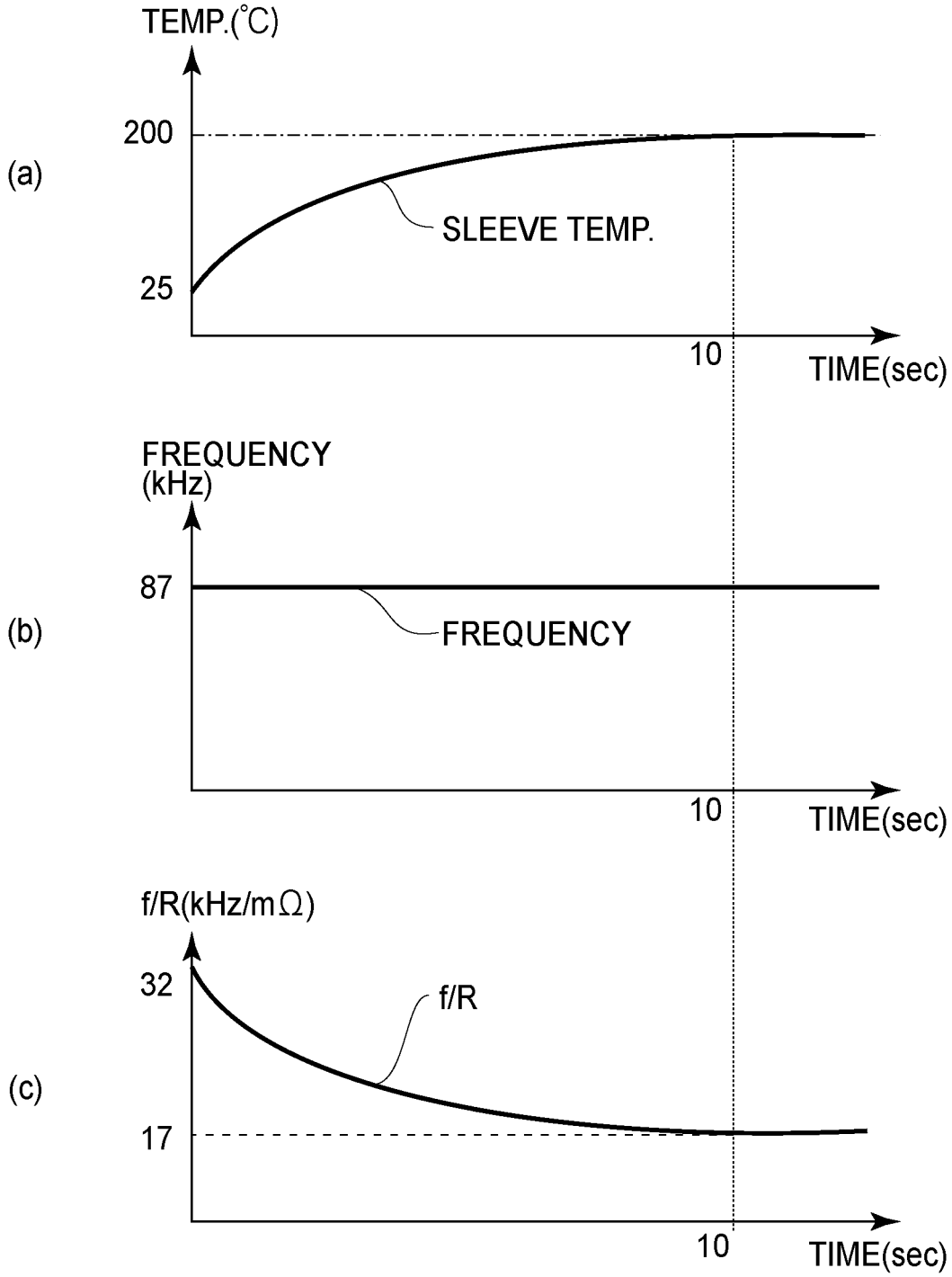
In FIG. 20, (a) to (c) are graphs showing a temperature, a frequency and f/R, respectively, of a fixing sleeve during rising.

In FIG. 20, (a) is progression of the temperature of the heat generating layer 1*a* at the central portion when the fixing device A is actuated from the room temperature in 10 sec. For simplicity, a state in which the surface temperature of the fixing sleeve 1 controlled at 200° C. and the temperature of the heat generating layer 1*a* are the same is shown. In FIG. 20, (b) shows a state in which the frequency is constant at 87 kHz. In such a situation, as shown in (c) of FIG. 20, in a rising period of 10 sec, f/R largely changes, so that also the heat generation distribution changes.

In order to suppress the change in heat generation distribution during this rising period, in this embodiment, the frequency is changed when necessary so that the f/R becomes constant during the rising period. This control is hereinafter referred to as "frequency control". That is, the engine controller 43 controls the frequency of the AC current, caused to pass through the exciting coil 3, by the frequency controller (frequency setting portion) 45 so that the f/R becomes constant in the rising period from start of energization to the exciting coil 3 until the temperature of the fixing sleeve 1 reaches a predetermined temperature. Here, the term "constant" includes the case where the f/R is substantially constant.

Figure 21:
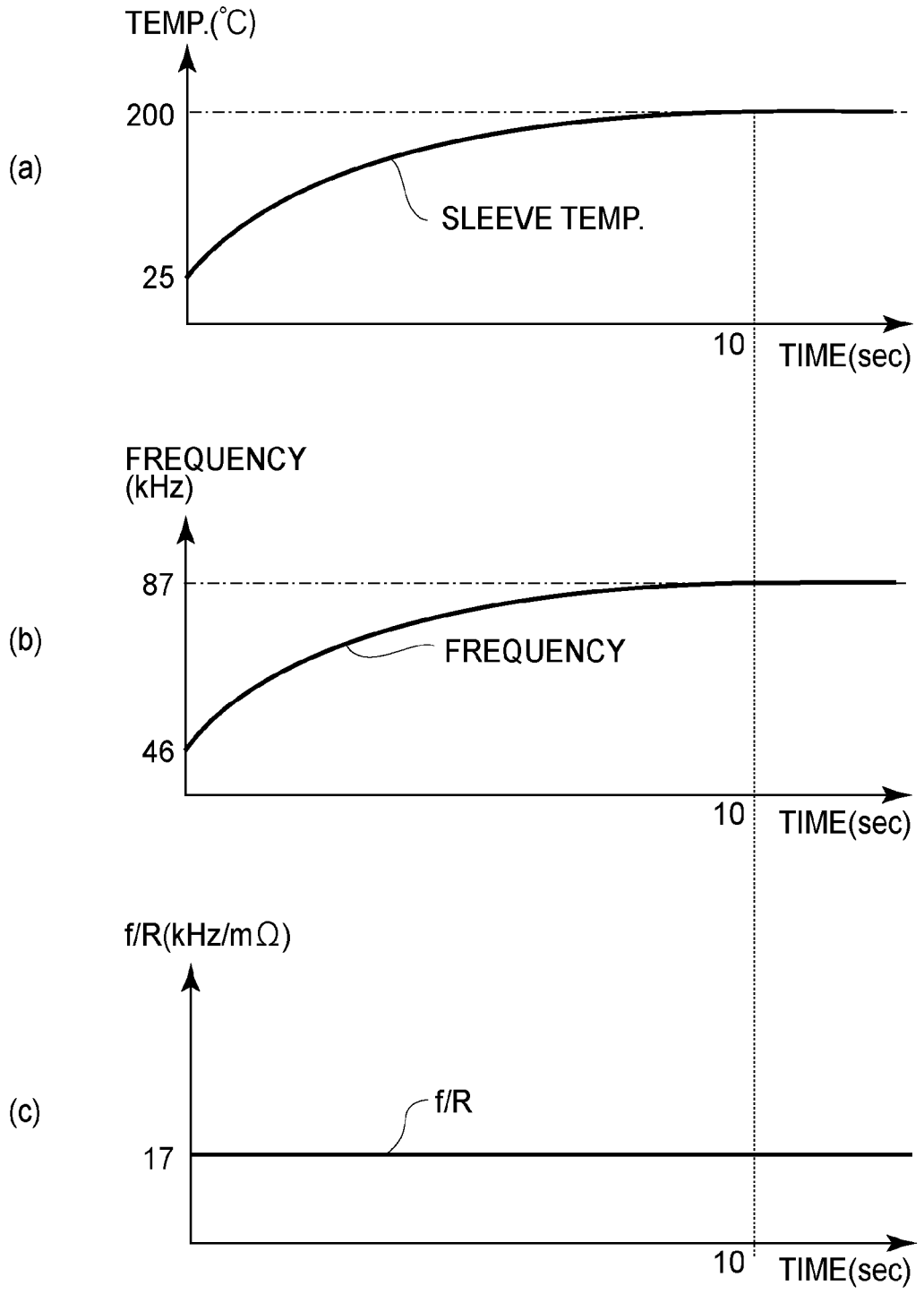
In FIG. 21, (a) to (c) are graphs showing the temperature, the frequency and the f/R, respectively, of the fixing sleeve in frequency control.

In FIG. 21, (a) shows progression of a central portion temperature of the heat generating layer 1*a* when the fixing device A is actuated from the room temperature in 10 sec, and is similar to (a) of FIG. 20. In FIG. 21, (b) shows a state in which the frequency is changed at any time. In such a situation, as shown in (c) of FIG. 21, the f/R can be made constant in 10 sec which is the rising period, and therefore the heat generation distribution during the rising period can be always made uniform.

A frequency control method will be described. The temperature detecting element 9 disposed at the longitudinal central portion of the fixing sleeve 1 always monitors the surface temperature of the fixing sleeve 1 at the central portion, and the fixing temperature controller 44 effects temperature control of the fixing device A on the basis of the temperature detected by the temperature detecting element 9. The frequency controller 45 effects control of switching of the frequency when necessary so that the f/R becomes constant, on the basis of the surface temperature of the fixing sleeve 1 as information from the fixing temperature controller 44 and information of the TCR of the heat generating layer 1*a* stored in the storing portion 47 such as memory.

That is, when an output temperature of the temperature detecting element 9 at the time of start of the rising is $T_0$, an output temperature of the temperature detecting element 9 during the rising is $T_1$, the frequency at the time of start of rising is $f_0$, and the frequency during the rising is $f_1$, the frequency is controlled so as to satisfy the following formula (13).

$$f_1 = f_0(1+\mathrm{TCR}\times(T_1-T_0) \tag{13}$$

9. Effect of Embodiment 1

Table 2 is a summary of constitutions of Embodiment 1 described above and Comparison Example 1 and the presence or absence of the image defect. Comparison Example 1 is the case where the frequency control in this embodiment is not effected. Embodiment 1 is the case where the frequency control in this embodiment is effected.

The image defect shown in Table 2 was checked in the following manner. As the recording material P, an A3-sized paper of 80 g/m$^2$ in basis weight was used, and the fixing sleeve 1 was temperature-controlled on a longitudinal center line basis. The control temperature was 200° C., and printing of one sheet was made immediately after the image heating apparatus A was actuated to increase the temperature up to 200° C. in 10 sec., and then the image formed on the recording material P was checked by eye observation. A feeding speed of the recording material P is 300 mm/sec, and a sheet interval between the recording materials P is 40 mm.

TABLE 2

| | FC*1 | ST*2 | ID*3 |
|---|---|---|---|
| COMP. EX. 1 | NO | 226 | HOT OFFSET |
| EMB. 1 | YES | 198 | NOT OCCURRED |

*1"FC" is the frequency control.
*2"ST" is the fixing sleeve temperature (° C.) at the end portions of the image forming region immediately after the rising.
*3"ID" is the image defect.

In the following, generation of the image defect when the end portion temperature of the fixing sleeve 1 is high will be described. Under the conditions in this experiment, a toner which causes improper fixing at the sleeve temperature of 186° C. or less and which causes a hot offset at the sleeve temperature of 203° C. or more.

The improper fixing is evaluated based on fixing non-uniformity generated by non-uniform deformation of the toner, glossiness and a fixing property. Further, the hot offset is the image defect such that the toner excessively melted when the temperature of the fixing sleeve 1 is high, and is deposited on the fixing sleeve 1 and then is transferred and fixed on the recording material P after rotation of the fixing sleeve 1 through one full circumference thereby to contaminate the recording material P with the toner.

In Comparison Example 1, at the end portions of the image forming region, the fixing sleeve temperature is 226° C., and therefore the hot offset generates. On the other hand, in Embodiment 1, the fixing sleeve temperature is 198° C. at the end portions of the image forming region, and therefore the improper fixing and the hot offset do not generate, so that it is possible to obtain a good image.

As described above, in this embodiment, during the rising of the fixing device A, the longitudinal heat generation distribution is made uniform irrespective of the TCR of the heat generating layer 1*a* of the fixing sleeve 1, so that the good image can be obtained.

In this embodiment, in other words, the frequency of the current caused to pass through the exciting coil 3 is controlled so that the heat generation distribution of the heat generating layer 1*a* with respect to the generatrix direction of the fixing sleeve 1 becomes constant in the warm-up period of the fixing device A.

Embodiment 2

In Embodiment 2, the TCR of the heat generating layer 1*a* is negative (NTC characteristic), and other constitutions are similar to those in Embodiment 1.

10. Influence of TCR of Heat Generating Layer (NTC Characteristic)

Figure 22:
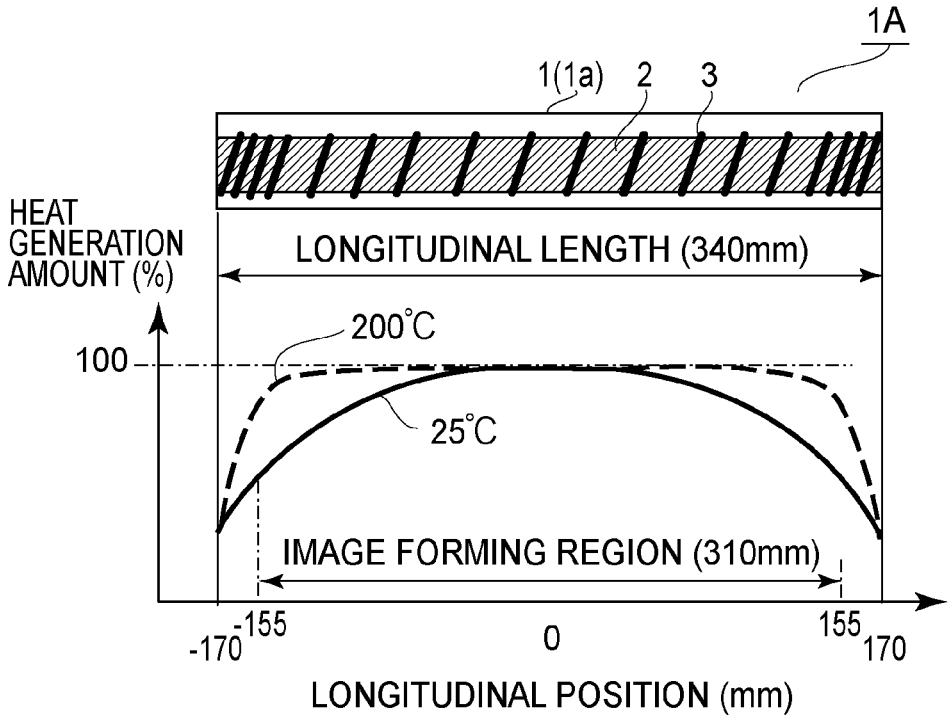
FIG. 22 is a schematic view showing a heat generation distribution.

As in this embodiment, in the case where the TCR is negative, as shown in FIG. 22, the end portion heat generation amount is small during the rising. For that reason, the temperature distribution of the fixing sleeve 1 immediately after the rising is such that the end portion temperature is low.

Figure 23:
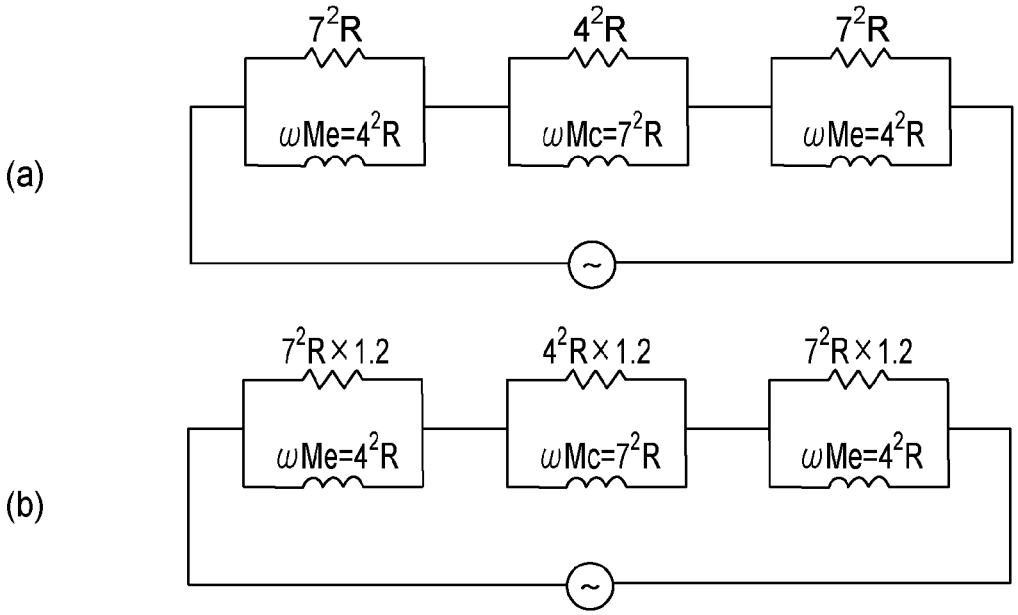
In FIG. 23, each of (a) and (b) shows an equivalent circuit.

The reason why the heat generation amount at the end portion is small will be described. Description will be described using the equivalent circuit in the model in which the circuit is divided into three portions with respect to the longitudinal direction as shown in (b) of FIG. 12 used for illustrating the heat generation amounts at the end portions and the central portion. In FIG. 23, (a) and (b) are equivalent circuits in the case where the exciting coil 3 is wound densely at the end portions. In this case, the exciting coil 3 is wound 7 times at the end portions and is wound 4 times at the central portion. In FIG. 23, (a) shows a state of 200° C. which is the control temperature and a state in which heat is generated uniformly. For that reason, in order to simplify calculation, the following equations are used.

$$\omega Me=4^2R$$

$$\omega Mc=7^2R$$

In these equivalent circuits, the impedance is the same at the end portions and the central portion, and therefore heat is generated uniformly.

In this embodiment, as the heat generating layer 1*a*, the metal film of 6.2 mΩ in circumferential direction resistance R at room temperature of 25° C. and 1000 ppm/° C. in TCR is used. At 200° C. which is the control temperature, the circumferential direction resistance R of the heat generating layer 1*a* is 5.1 mΩ. For that reason, at the room temperature of 25° C., the circumferential direction resistance R is 1.2 times the circumferential direction resistance R at the control temperature of 200° C.

In FIG. 23, (b) is the equivalent circuit in a state of the room temperature of 25° C. In this case, when synthetic impedances Xe and Xc at the end portions and the central portion are calculated similarly as in the formulas (5) and (6), the following formulas (14) and (15) are obtained.

$$|X_e| = \frac{1}{\sqrt{\left(\frac{1}{7^2R\times 1.2}\right)^2+\left(\frac{1}{4^2R}\right)^2}} = 15.3\ R \tag{14}$$

$$|X_c| = \frac{1}{\sqrt{\left(\frac{1}{4^2R\times 1.2}\right)^2+\left(\frac{1}{7^2R}\right)^2}} = 16.5\ R \tag{15}$$

From the formulas (14) and (15), the end portion impedance Xe is smaller than the central portion impedance Xc, and therefore the heat generation amount at the end portions at the room temperature of 25° C. is lower than the heat generation amount at the central portion. Similarly, also in a period of 25° C.-200° C., the end portion heat generation amount is lower than the central portion heat generation amount.

11. Frequency Control of Embodiment 1

In order to suppress the change in heat generation distribution during this rising period, in this embodiment, the frequency control is effected so that the f/R becomes constant during the rising period.

Figure 24:
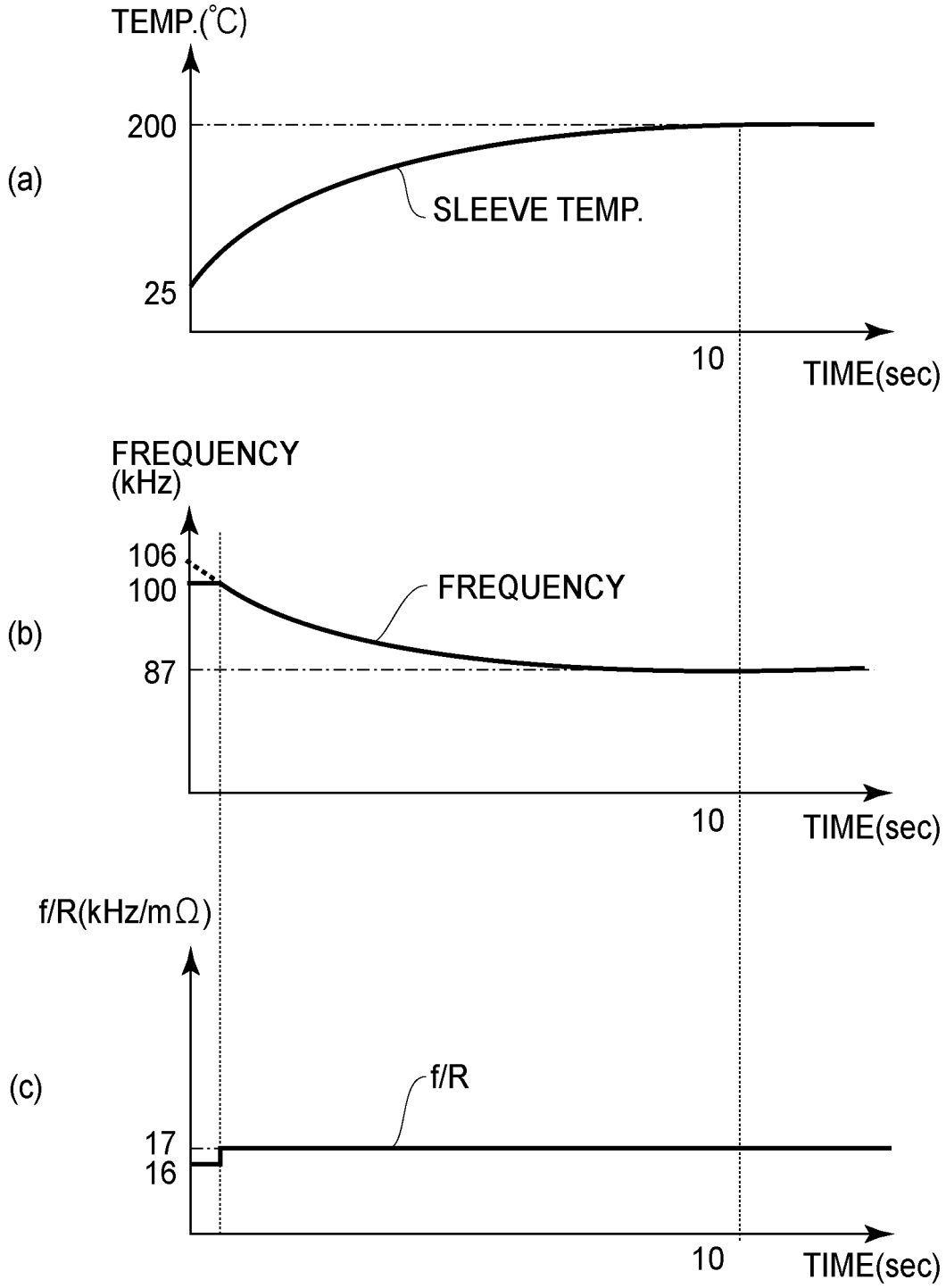
In FIG. 24, (a) to (c) are graphs showing a temperature, a frequency and f/R, respectively, of a fixing sleeve during rising.
Figure 25:
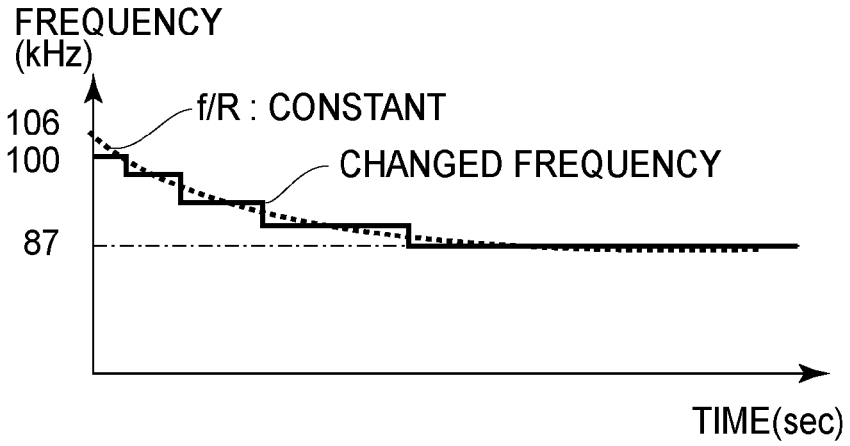
FIG. 25 is a graph showing a state in which the frequency is stepwisely switched.

In FIG. 24, (a) is progression of the temperature of the heat generating layer 1*a* at the central portion when the fixing device A is actuated from the room temperature in 10 sec. In FIG. 24, a solid line in (b) shows a state in which the frequency is changed at any time. In such a situation, as shown in (c) of FIG. 24, the f/R can be caused to approach a constant level in 10 sec which is the rising period, and therefore the heat generation distribution during the rising period can be caused to approach a uniform distribution.

In the frequency control in Embodiment 2 shown by the solid line in (b) of FIG. 24, there is a section where the frequency is fixed at 100 kHz at an initial stage of the rising. This is because a band of the frequency usable for the fixing device A is limited. As the frequency of the electric power supplied to the exciting coil 3, it is possible to use a range of 20.05 kHz-100 kHz in view of a technical requirement for obtaining designation of the type relating to the image forming apparatus based on the radio act enforcement regulations.

For that reason, in this embodiment, although the initial frequency for making the f/R constant is 106 kHz, in order not to provide the frequency of 100 kHz or more, the frequency controller 45 shown in FIG. 3 controls the frequency.

The control is effected in such a manner, and therefore, as shown in (c) of FIG. 24, there is a low f/R period at the initial stage of the rising, and in this period, the heat generation distribution is not uniform. However, in this embodiment, this period is less than 1 sec, and thus is very short compared with the rising period of 10 sec, and therefore the influence thereof is small.

12. Effect of Embodiment 2

Table 3 is a summary of constitutions of Embodiment 2 described above and Comparison Example 2 and the presence or absence of the image defect. Comparison Example 2 is the case where the frequency control in this embodiment is not effected. Embodiment 2 is the case where the frequency control in this embodiment is effected.

The image defect shown in Table 3 was checked in the following manner. As the recording material P, an A3-sized paper of 80 g/m$^2$ in basis weight was used, and the fixing sleeve 1 was temperature-controlled on a longitudinal center line basis. The control temperature was 200° C., and printing of one sheet was made immediately after the image heating apparatus A was actuated to increase the temperature up to 200° C. in 10 sec., and then the image formed on the recording material P was checked by eye observation. A feeding speed of the recording material P is 300 mm/sec, and a sheet interval between the recording materials P is 40 mm.

TABLE 3

| | FC*1 | ST*2 | ID*3 |
|---|---|---|---|
| COMP. EX. 2 | NO | 182 | IMPROPER FIXING |
| EMB. 2 | YES | 197 | NOT OCCURRED |

*1"FC" is the frequency control.
*2"ST" is the fixing sleeve temperature (° C.) at the end portions of the image forming region immediately after the rising.
*3"ID" is the image defect.

In the following, generation of the image defect when the end portion temperature of the fixing sleeve 1 is high will be described. Under the conditions in this experiment, a toner which causes improper fixing at the sleeve temperature of 186° C. or less and which causes a hot offset at the sleeve temperature of 203° C. or more.

The improper fixing is evaluated based on fixing non-uniformity generated by non-uniform deformation of the toner, glossiness and a fixing property. Further, the hot offset is the image defect such that the toner excessively melted when the temperature of the fixing sleeve 1 is high, and is deposited on the fixing sleeve 1 and then is transferred and fixed on the recording material P after rotation of the fixing sleeve 1 through one full circumference thereby to contaminate the recording material P with the toner.

In Comparison Example 2, at the end portions of the image forming region, the fixing sleeve temperature is 182° C., and therefore the improper fixing generates. On the other hand, in Embodiment 2, the fixing sleeve temperature is 197° C. at the end portions of the image forming region, and therefore the improper fixing and the hot offset do not generate, so that it is possible to obtain a good image.

Incidentally, as in this embodiment, there is also an instance in which the f/R is not required to be maintained at a completely constant level. For this reason, as shown in FIG. 24 by a solid line, a plurality of stages where the frequency is switched are provided, and the frequency may be gradually switched, i.e., the frequency is stepwisely shifted. That is, in this embodiment, the f/R may only be required to made substantially constant.

As described above, in this embodiment, during the rising of the fixing device A, the longitudinal heat generation distribution is made uniform irrespective of the TCR of the heat generating layer 1*a* of the fixing sleeve 1, so that the good image can be obtained.

Embodiment 3

In this embodiment, in addition to the frequency control during the rising of the fixing device A, the frequency control is effected also during a printing job. Other constitutions are similar to those in Embodiment 1.

In the fixing device A, e.g., as the following two examples, the control temperature is switched during the printing job in some cases.

A first example is temperature control depending on a species of the recording material. In a single printing job, plain paper and coated paper exist in mixture and are finished in a single product in some cases. As the plain paper, e.g., there are thick paper, thin paper, a recycled paper, and so on. These papers are treated in general as papers having the same surface property and different basis weights. As the coated paper, there are one-side coated paper, both-side coated paper, and so on. In the case where a plurality of recording materials different in species or thickness are used in one printing job, in order to properly fix the toner image on the recording material, the control temperature suitable for the recording material is required to be switched every species of the recording material.

A second example is temperature control depending on a printing history. In the fixing device A, a heat quantity supplied to the recording material varies depending on the temperature of the pressing roller 8, and therefore the control temperature is always changed so as to supply a constant heat quantity to the recording material depending on the number of sheets subjected to printing (image formation), an elapsed time from the last fixing process, or the like. Specifically, when the temperature of the pressing roller 8 after turning-on of the switch of the voltage source is low, the control temperature is set at a high level, and thereafter when the temperature of the pressing roller 8 is high during the printing (image formation), the control temperature is gradually lowered. As a result, it is possible to prevent the improper fixing and the hot offset.

In this way, in the case where the control temperature is switched during the printing job, the temperature of the heat generating layer 1*a* changes during the printing job. Then, by the influence of the TCR of the heat generating layer 1*a*, the circumferential direction resistance R changes (i.e., the f/R changes), so that the heat generation distribution of the fixing sleeve 1 with respect to the longitudinal direction changes.

In order to suppress the change in heat generation distribution during the printing job, in this embodiment, the frequency is changed at all times so that the f/R becomes constant during the printing job. That is, the engine controller 43 controls the frequency of the AC current, caused to pass through the exciting coil 3, by the frequency controller (frequency setting portion) 45 so that the f/R becomes constant when energization to the exciting coil 3 is effected also after the rising period is ended.

Figure 26:
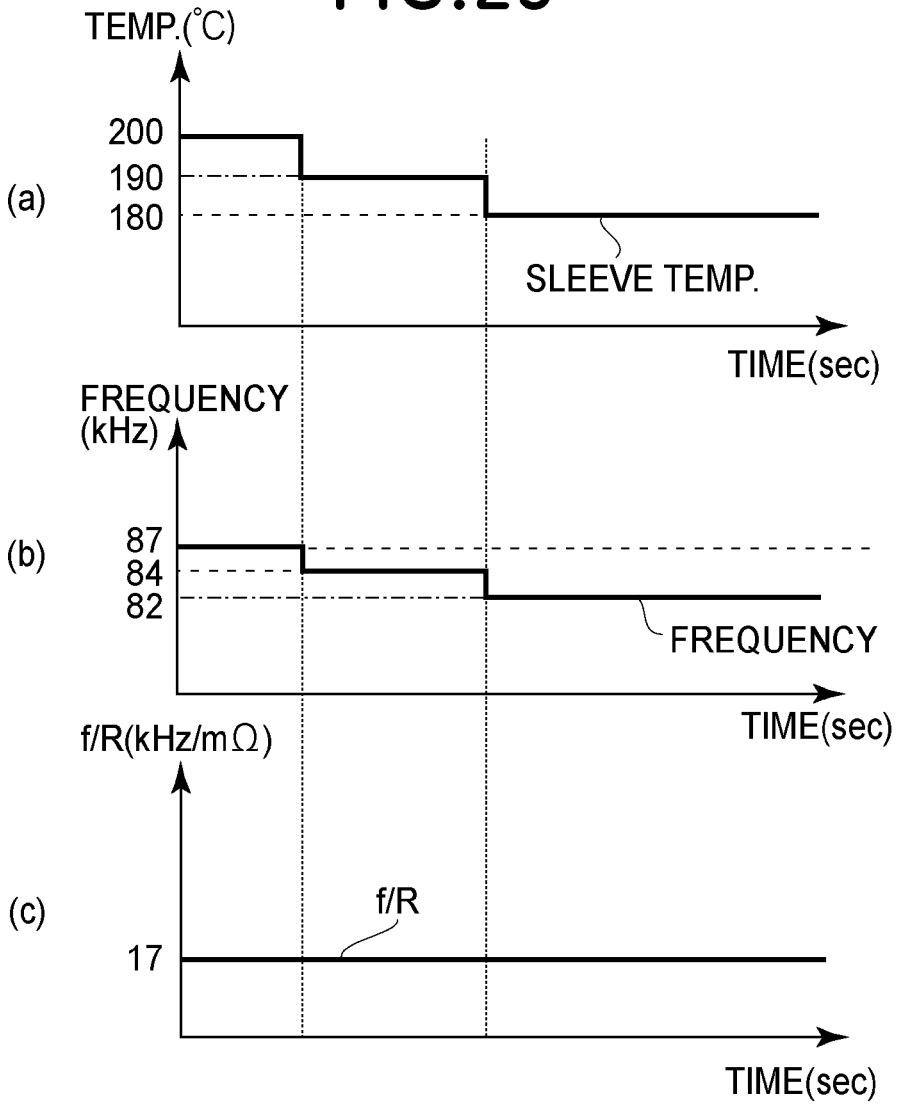
In FIG. 26, (a) to (c) are graphs showing a temperature, a frequency and f/R, respectively, of a fixing sleeve during printing job.

In FIG. 26, (a) shows progression of the control temperature of the heat generating layer 1*a* at the central portion during the printing job. In the case where continuous printing is effected, the temperature control is made at 200° C. at the initial stage, but the temperature of the pressing roller 9 becomes high and therefore a state in which the control temperature is lowered at an intermediate stage is shown. In FIG. 26, (b) shows a state in which the frequency is changed when necessary. The frequency is shifted depending on switching timing of the control temperature. In such a situation, as shown in (c) of FIG. 26, the f/R can be made constant during the printing job, and therefore the heat generation distribution during the printing job can be always made uniform.

As described above, in this embodiment, during the printing job, the longitudinal heat generation distribution is made uniform irrespective of the TCR of the heat generating layer 1*a* of the fixing sleeve 1, so that the good image can be obtained.

Embodiment 4

This embodiment has the same constitution as in Embodiment 1 except that the pressing roller 8 is different from that in Embodiment 1. In the pressing roller 8 in this embodiment, in order to suppress a so-called non-paper-passing region temperature rise in a region where the recording material does not pass when the small-sized recording material is subjected to the continuous printing, thermal conductivity of the elastic (material) layer 8*b* is 1.5 W/mK which is high. In Embodiment 1, the thermal conductivity of the elastic layer is 0.2 W/mK. The pressing roller 8 has a large amount of heat dissipation from the longitudinal end portions which are most liable to be exposed to the air, and thus the temperature there is liable to lower. Particularly, in the case where the thermal conductivity of the elastic layer 8*b* is high, the pressing roller 8 easily takes heat from the fixing sleeve 1, and therefore, the temperature of the fixing sleeve 1 at the longitudinal end portions is liable to lower. For this reason, when the frequency control is effected so that the f/R is constant as in Embodiment 1, the heat generation amount at the longitudinal end portions is insufficient in some cases.

In this embodiment, the frequency control is effected so that the f/R is larger than the r/R in Embodiment 1 during the rising period.

Figure 27:
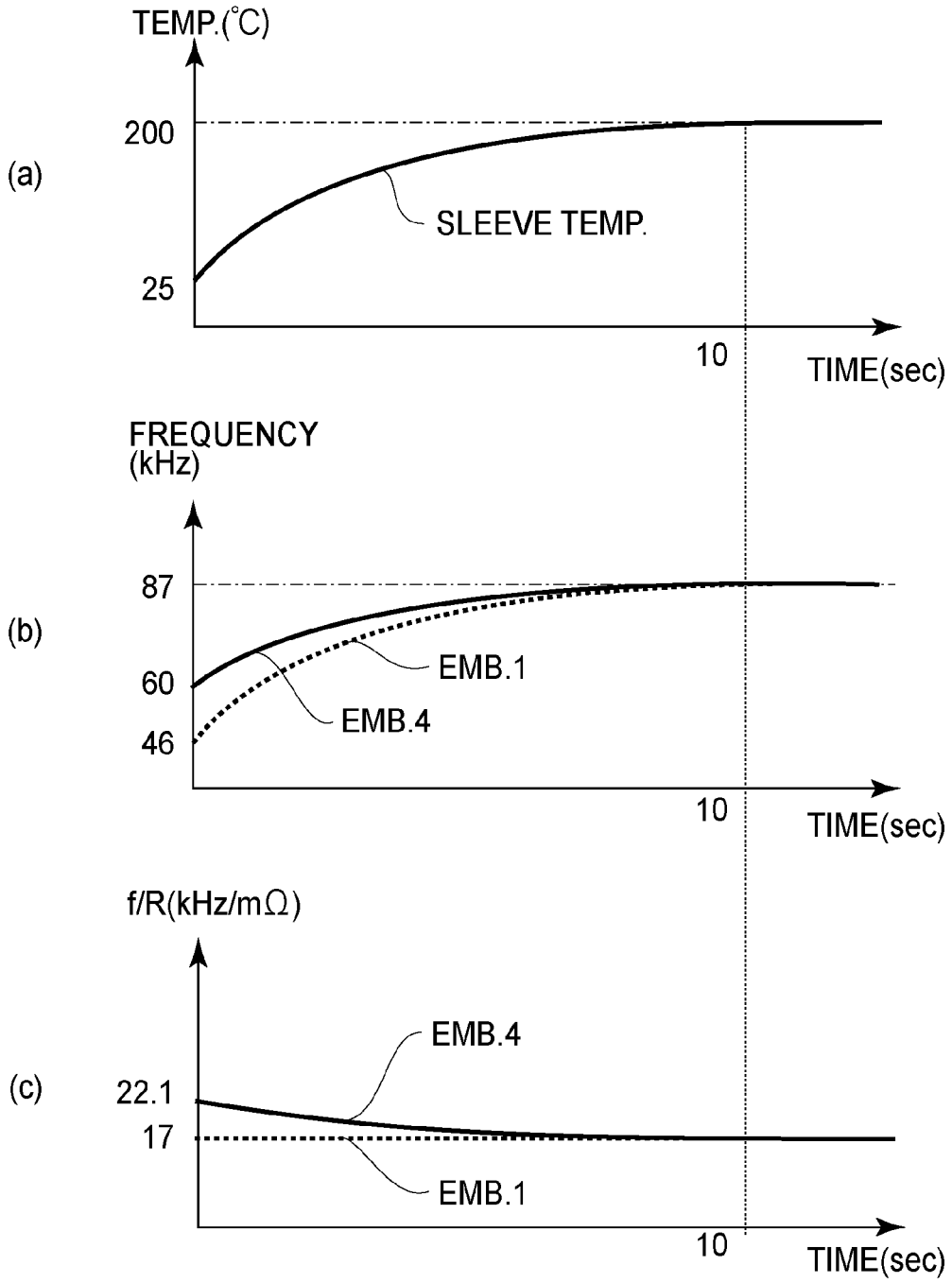
In FIG. 27, (a) to (c) are graphs showing a temperature, a frequency and f/R, respectively, of a fixing sleeve during rising.

In FIG. 27, (a) is progression of the temperature of the heat generating layer 1*a* at the central portion when the fixing device A is actuated from the room temperature in 10 sec. In FIG. 27, a solid line in (b) shows a state in which the frequency is changed at any time, in this embodiment. In this state, the frequency is 30% higher than the frequency at the time of start of the rising, and gradually approaches the frequency indicated by the dotted line in Embodiment 1. That is, in the warm-up period of the fixing device, the frequency is controlled so that the f/R starts from a value larger than a predetermined value and then gradually converges to the predetermined value.

By effecting this frequency control, the f/R of this embodiment indicated by the solid line in (c) of FIG. 27 is 30% higher in value than the f/R in Embodiment 1 indicated by the dotted line in (c) of FIG. 27 at the time of start of the rising, and then gradually approaches the f/R indicated by the dotted line. For that reason, the heat generation amount of the fixing sleeve 1 at the longitudinal end portions becomes large, and is canceled with the temperature lowering due to the heat dissipation of the pressing roller 8, so that the heat generation distribution of the fixing sleeve 1 during the rising period can be caused to uniformly approach a uniform value. In Embodiment 4, the reason why the f/R is not 30% higher than the f/R in Embodiment 1 over an entire period during the rising is that excessive temperature rise at the longitudinal end portions is intended to be prevented.

An effect of this embodiment will be described.

Table 4 is a summary of constitutions of Embodiment 4 described above and Comparison Example 3 and the presence or absence of the image defect. Comparison Example 3 is the case where the frequency control in Embodiment 1 is effected. Embodiment 4 is the case where the frequency control in this embodiment is effected.

The image defect shown in Table 4 was checked similarly as in Embodiment 1. As the recording material P, an A3-sized paper of 80 g/m$^2$ in basis weight was used, and the fixing sleeve 1 was temperature-controlled on a longitudinal center line basis. The control temperature was 200° C., and printing of one sheet was made immediately after the image heating apparatus A was actuated to increase the temperature up to 200° C. in 10 sec., and then the image formed on the recording material P was checked by eye observation. A feeding speed of the recording material P is 300 mm/sec, and a sheet interval between the recording materials P is 40 mm.

TABLE 4

| | FC*1 | ST*2 | ID*3 |
|---|---|---|---|
| COMP. EX. 3 | NO | 181 | IMPROPER FIXING |
| EMB. 4 | YES | 194 | NOT OCCURRED |

*1"FC" is the frequency control.
*2"ST" is the fixing sleeve temperature (° C.) at the end portions of the image forming region immediately after the rising.
*3"ID" is the image defect.

In the following, generation of the image defect when the end portion temperature of the fixing sleeve 1 is low will be described. Under the conditions in this experiment, a toner which causes improper fixing at the sleeve temperature of 186° C. or less and which causes a hot offset at the sleeve temperature of 203° C. or more. The improper fixing is evaluated based on fixing non-uniformity generated by non-uniform deformation of the toner, glossiness and a fixing property. Further, the hot offset is the image defect such that the toner excessively melted when the temperature of the fixing sleeve 1 is high, and is deposited on the fixing sleeve 1 and then is transferred and fixed on the recording material P after rotation of the fixing sleeve 1 through one full circumference thereby to contaminate the recording material P with the toner. In Comparison Example 3, at the end portions of the image forming region, the fixing sleeve temperature is 181° C., and therefore the improper fixing generates. On the other hand, in Embodiment 4, the fixing sleeve temperature is 194° C. at the end portions of the image forming region, and therefore the improper fixing and the hot offset do not generate, so that it is possible to obtain a good image.

As described above, in this embodiment, during the rising of the fixing device A, the longitudinal temperature distribution is made uniform irrespective of the TCR of the heat generating layer 1*a* of the fixing sleeve 1 and the thermal conductivity of the pressing roller 8, so that the good image can be obtained.

Other Embodiments (1) The image heating apparatus may include, other than the fixing device for fixing the unfixed toner image as the fixed image, an image quality improving device for improving a glossiness of the image by a re-heating and re-pressing the toner image which is temporarily fixed on the recording material or which is once heat-fixed on the recording material.

(2) The cylindrical rotatable member 1 including the electroconductive layer 1*a* can also be formed in a flexible endless belt which is extended and stretched around a plurality of stretching members and which is rotationally driven. Further, the cylindrical rotatable member 1 including the electroconductive layer 1*a* can also be formed in a hard hollow roller or pipe.

(3) The nip forming member 8 for forming the fixing nip N in cooperation with the cylindrical rotatable member 1 having the electroconductive layer 1*a* as the rotatable heating member may also be a rotatable member rotated by the rotation of the rotatable member 1 in the case where the rotatable member 1 is rotationally driven.

Further, in the case where the rotatable member 1 is rotationally driven, the nip forming member 8 may also be a non-rotatable member such as an elongated pad-shaped member having a surface friction coefficient smaller than those of the rotatable member 1 and the recording material P. The recording material P introduced in the fixing nip N is nipped and fed through the fixing nip N by a rotational feeding force of the rotatable member 1 while being slid with the surface of the nip forming member which is in the form of the non-rotatable member and which has a small friction coefficient.

(4) In the image forming apparatus, the image forming portion 113 for forming the toner image is not limited to the electrophotographic image forming portion of the transfer type in Embodiments 1 to 4. For example, the image forming portion may also be an electrophotographic image forming portion where photosensitive paper is used as the recording material and the toner image is formed on the paper in a direct manner. The image forming portion may also be an electrostatic recording image forming portion or a magnetic recording image forming portion of a transfer type in which an electrostatic recording dielectric member or a magnetic recording (magnetic) member is used as the image bearing member. Further, the image forming portion may also be an electrostatic recording image forming portion or a magnetic recording image forming portion where electrostatic recording paper or magnetic recording paper is used as the recording material, and the toner image is formed on the paper in a direct manner.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-173914 filed on Aug. 28, 2014, which is hereby incorporated by reference herein in its entirety.

What is claimed is:

1. A fixing device for fixing a toner image on a recording material, comprising:

a rotatable member including an electroconductive layer;

a helical coil provided at a hollow portion of said rotatable member, a helical axis of said helical coil extending along a generatrix direction of said rotatable member;

a magnetic core provided inside a helically shaped portion formed by said helical coil; and a controller configured to control a frequency of an AC current caused to flow through said helical coil, wherein the AC current is caused to flow through said helical coil to cause the electroconductive layer to generate heat through electromagnetic induction heating to thereby heat and fix the toner image on the recording material by heat of said rotatable member, and wherein said controller controls the frequency in a predetermined period so that, when the frequency is denoted by f and a resistance of the electroconductive layer with respect to a circumferential direction is denoted by R, f/R is substantially constant.

2. The fixing device according to claim 1, wherein the predetermined period is a period in which the warm up of the fixing device is executed.

3. The fixing device according to claim 1, wherein the period is a period in which a fixing process is executed.

4. The fixing device according to claim 1, further comprising a temperature detecting member configured to detect the surface temperature of said rotatable member, wherein when the detection temperature of said temperature detecting member and the frequency when a warm up of the fixing device is started are denoted by $T_0$ and $f_0$, respectively, the detection temperature of said temperature detecting member and the frequency during a period in which the warm up of the fixing device is executed are denoted by $T_1$ and $f_1$, respectively, and a temperature coefficient of resistance of the electroconductive layer is TCR, the fixing device satisfies: $f_1=f_0(1+TCR\times(T_1-T_0))$.

5. The fixing device according to claim 1, wherein the frequency is controlled in a range of 20.05 kHz<f<100 kHz.

6. The fixing device according to claim 1, wherein said rotatable member is a film.

7. The fixing device according to claim 6, further comprising, a nip forming member contacting an inner surface of said film, and a pressing member configured to form a nip in cooperation with said nip forming member, said film being interposed between said pressing member and said nip forming member.

8. The fixing device according to claim 1, wherein the fixing device is constituted so that 70% or more of magnetic flux coming out of one end of said magnetic core passes through an outside of the electroconductive layer and enters the other end of said magnetic core.

9. The fixing device according to claim 1, wherein the electroconductive layer generates heat by a induced current flowing in the electroconductive layer in a circumferential direction of said rotatable member, the induced current being induced by the AC current.

10. A fixing device for fixing a toner image on a recording material, comprising:

a rotatable member including an electroconductive layer;

a helical coil provided at a hollow portion of said rotatable member, a helical axis of said helical coil extending along a generatrix direction of said rotatable member;

a magnetic core provided inside a helically shaped portion formed by said helical coil; and a controller configured to control a frequency of an AC current caused to flow through said helical coil, wherein the AC current is caused to flow through said helical coil to cause the electroconductive layer to generate heat through electromagnetic induction heating to thereby to heat and fix the toner image on the recording material by heat of said rotatable member, and wherein said controller controls the frequency in a period in which a warm up of the fixing device is executed so that when the frequency is denoted by f and a resistance of the electroconductive layer with respect to a circumferential direction is denoted by R, f/R starting from a value larger than an predetermined value converges to the predetermined value.

11. The fixing device according to claim 10, further comprising a temperature detecting member configured to detect a surface temperature of said rotatable member, wherein when a detection temperature of said temperature detecting member and the frequency when a warm up of the fixing device is started are denoted by $T_0$ and $f_0$, respectively, the detection temperature of said temperature detecting member and the frequency during a period in which the warm up of the fixing device is executed are denoted by $T_1$ and $f_1$, respectively, and a temperature coefficient of resistance of the electroconductive layer is TCR, the fixing device satisfies: $f_1=f_0(1+TCR\times(Ti-T_0))$.

12. The fixing device according to claim 10, wherein the frequency is controlled in a range of 20.05 kHz<f<100 kHz.

13. The fixing device according to claim 10, wherein said rotatable member is a film.

14. The fixing device according to claim 13, further comprising, a nip forming member contacting an inner surface of said film, and a pressing member configured to form a nip in cooperation with said nip forming member, said film being interposed between said pressing member and said nip forming member.

15. The fixing device according to claim 10, wherein the fixing device is constituted so that 70% or more of magnetic flux coming out of one end of said magnetic core passes through an outside of the electroconductive layer and enters the other end of said magnetic core.

16. The fixing device according to claim 10, wherein the electroconductive layer generates heat by a induced current flowing in the electroconductive layer in a circumferential direction of said rotatable member, the induced current being induced by the AC current.

* * * * *